US007818932B2

(12) United States Patent
Eberlein et al.

(10) Patent No.: US 7,818,932 B2
(45) Date of Patent: Oct. 26, 2010

(54) PARTITION PANEL SYSTEM AND METHOD

(75) Inventors: David C. Eberlein, Hudsonville, MI (US); Daniel R. Van Dyk, Belding, MI (US); Michael L. Waalkes, Grand Rapids, MI (US); Davinder S. Dhanoa, Kentwood, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 12/587,872

(22) Filed: Oct. 14, 2009

(65) Prior Publication Data

US 2010/0064597 A1 Mar. 18, 2010

(51) Int. Cl.
*E04H 1/00* (2006.01)

(52) U.S. Cl. ..... 52/239; 52/241; 52/242; 52/309.11

(58) Field of Classification Search ..... 52/239, 52/309.11, 426, 275, 36.11, 241, 242
See application file for complete search history.

(56) References Cited

U.S. PATENT DOCUMENTS

| | | | |
|---|---|---|---|
| 3,398,981 | A | 8/1968 | Vincens |
| 4,408,928 | A | 10/1983 | Steinke |
| 4,716,699 | A | 1/1988 | Crossman et al. |
| 5,187,908 | A | 2/1993 | Losensky |
| 5,309,686 | A | 5/1994 | Underwood et al. |
| 5,606,836 | A | 3/1997 | Insalaco et al. |
| 5,740,650 | A | 4/1998 | Seiber et al. |
| 5,746,035 | A | 5/1998 | Seiber et al. |
| 5,816,001 | A | 10/1998 | Goodman et al. |
| 5,943,834 | A | 8/1999 | Jeffers et al. |
| 5,950,386 | A | 9/1999 | Shipman et al. |
| 6,000,179 | A | 12/1999 | Musculus et al. |
| 6,009,676 | A | 1/2000 | Feldpausch et al. |
| 6,044,612 | A | 4/2000 | Shipman et al. |
| 6,067,762 | A | 5/2000 | Greer et al. |
| 6,079,173 | A | 6/2000 | Waalkes et al. |
| 6,082,065 | A | 7/2000 | Feldpausch |
| 6,112,472 | A | 9/2000 | Van Dyk et al. |
| 6,134,845 | A | 10/2000 | Shipman et al. |
| 6,134,852 | A | 10/2000 | Shipman et al. |
| 6,167,676 | B1 | 1/2001 | Shipman et al. |
| 6,173,543 | B1 | 1/2001 | Gortsema et al. |
| 6,173,545 | B1 | 1/2001 | Feldpausch et al. |
| 6,230,459 | B1 | 5/2001 | Jeffers et al. |
| 6,276,102 | B1 | 8/2001 | Shipman et al. |
| 6,282,854 | B1 | 9/2001 | Vos et al. |
| 6,286,276 | B1 | 9/2001 | Shipman et al. |
| 6,378,255 | B1 | 4/2002 | Eich et al. |
| 6,397,532 | B1 | 6/2002 | Shipman et al. |
| 6,397,533 | B1 | 6/2002 | Hornberger et al. |

(Continued)

*Primary Examiner*—Basil Katcheves
(74) *Attorney, Agent, or Firm*—Price, Heneveld, Cooper, DeWitt & Litton, LLP

(57) ABSTRACT

An off-module connector system for a partition system detachably connects a first partition with a second partition in a non-parallel, angular relationship at a location on the first partition between the opposite side members thereof. The off-module connector system includes a top connector bracket which engages the attachment slots on the panel frames and a bottom connector bracket which engages an associated rack to securely, yet removably, mount the two partition panels in an off-modular relationship.

15 Claims, 20 Drawing Sheets

U.S. PATENT DOCUMENTS 6,481,163 B1 11/2002 King et al.
6,481,169 B1 11/2002 Ludwig et al.
6,520,357 B1 2/2003 Kautz et al.
6,684,929 B2 2/2004 MacDonald et al.
6,769,750 B2 8/2004 Hughes et al.

PARTITION PANEL SYSTEM AND METHOD

BACKGROUND OF THE INVENTION

The present invention relates to partition systems, and in particular to an off-module panel connector and related method.

Modern offices, and more particularly office partition systems, are becoming increasingly complicated and sophisticated due largely to the ever-increasing needs of the users for improved reconfigurability, functionality, utility support, and the need for additional readily attachable furniture components.

The efficient use of building floor space is an ever-growing concern, particularly as building costs continue to escalate. In an effort to reduce these costs, open office plans have been developed, wherein generally large, open floor spaces are equipped with modular furniture systems which are readily reconfigurable to accommodate the ever-changing needs of a specific user, as well as the divergent requirements of different tenants. One arrangement commonly used for furnishing these open spaces includes movable partition panels which are detachably interconnected in a preselected configuration to partition or segment the open spaces into individual workstations and/or offices. Such partition panels can be set up or installed in a variety of configurations, and are reconfigurable, thereby responding to the changing needs of the office environment. For example, to allow for maximum design flexibility, the partitions should be configurable such that the panels can be attached in either an "on-module" configuration, wherein the panels are interconnected to the main run of panels (also called the "spine wall") at the ends thereof, or an "off-module" configuration, wherein the panels are interconnected to the "spine wall" intermediate the ends thereof.

Typically, these partition systems also include a series of horizontal and vertical slots or openings disposed along the top and side edges of the panel, respectively. The slots are designed to receive hang-on furniture accessories, such as worksurfaces, overhead cabinets, shelves, binder bins, etc., generally known in the office furniture industry as "systems furniture". These partition systems may also include modular furniture components which address the increased need and desirability for distributing utilities throughout the various offices in a manner which can be readily reconfigured. The term "utilities", as used herein, is meant to include a wide variety of facilities and/or components for use at a workstation and includes security devices, electrical power, signal and/or communications, HVAC, water and other fluids, and other similar resources. The ability to provide the worker with ready access to all of these utilities is clearly advantageous in the quest to promote worker well-being and effectiveness. These types of modular furniture systems, as well as others, have been well received due largely to their ability to be readily reconfigured and/or moved to a new site since they are not part of a permanent leasehold improvement.

In order to gain increased efficiency in the use of expensive office real estate, attempts are now being made to support high paid knowledge workers with these types of modular furniture systems in open office settings. However, in order to ensure peak efficiency of such knowledge workers, the workstations must be equipped with these various state-of-the-art utilities and facilities as discussed above. Additionally, these same workstations must be readily reconfigurable to effectively meet the ever-changing needs of the user.

The distribution and control of utilities throughout a comprehensive open office plan, while simultaneously providing for the unique requirements of the office user, has emerged as a major challenge to the office furniture industry. Accordingly, a furniture construction solving the aforementioned problems is desired.

SUMMARY OF THE INVENTION

One aspect of the present invention is a partition system of the type having at least first and second partition panels, each including a generally rectangular frame defined by rigidly interconnected top, bottom and opposite side members, with a plurality of horizontal slots extending along the top member, a plurality of vertical slots extending along the opposite side members, and at least one vertically oriented mounting aperture disposed adjacent one end of the top member. A skin covers at least a major portion of the frame, while leaving the horizontal slots and the vertical slots exposed. The partition system includes an off-module connector detachably connecting the first partition panel with the second partition panel in a non-parallel, angular relationship at a location on the first partition panel between the opposite side members thereof. The off-module connector includes a top connector bracket having a hook portion thereof detachably engaged in one of the horizontal slots on the first partition panel, a plate portion thereof positioned generally opposite the hook portion, and including at least one vertically oriented fastener aperture positioned to mate with the mounting aperture on the second partition panel. A first fastener is inserted through the fastener aperture in the top connector bracket and is engaged in the mounting aperture on the second partition panel. The off-module connector also includes a bottom connector bracket having a hook portion thereof detachably engaged in one of the vertical slots on the second partition panel, a plate portion thereof positioned generally opposite the hook portion of the bottom connector bracket, and including at least one horizontally oriented fastener aperture positioned overlying the skin of the first partition panel at a vertical location aligned with the bottom member of the first partition panel. A second fastener is inserted into the fastener aperture in the bottom bracket, extends through the skin of the first partition panel, and is anchored in the bottom member of the first partition panel to securely, yet removably, mount the second partition panel on the first partition panel in an off-modular relationship.

Another aspect of the present invention is a partition having at least first and second panels, each including a frame defined by rigidly interconnected top, bottom and opposite side members, with a plurality of horizontal slots extending along the top member, a plurality of vertical slots extending along the opposite side members, and at least one mounting surface disposed adjacent the top member and an end thereof. A skin covers at least a portion of the frame, while leaving the horizontal slots and the vertical slots exposed. The partition includes an off-module connector detachably connecting the first panel with the second panel in a non-parallel, angular relationship at a location on the first panel between the opposite side members thereof. The off-module bracket includes a top connector bracket having a hook portion thereof detachably engaged in one of the horizontal slots on the first panel, and a plate portion thereof detachably connected with the mounting surface on the second panel. The off-module connector also includes a bottom connector bracket having a hook portion thereof detachably engaged in one of the vertical slots on the second panel, and a plate portion thereof including at least one horizontally oriented fastener aperture positioned overlying the skin of the first panel at a vertical location aligned with the bottom member on the first panel. A fastener is inserted into the fastener aperture in the bottom connector bracket, extends through the skin of the first panel, and is anchored in the bottom member of the first panel to securely, yet removably, mount the second panel on the first panel in an off-modular relationship.

Yet another aspect of the present invention is an off-module connector for partition systems of the type having at least first and second panels, each including a generally rectangular frame defined by rigidly interconnected top, bottom and opposite side members, with a plurality of horizontal slots extending along the top member, a plurality of vertical slots extending along the opposite side members, and at least two vertically oriented mounting apertures adjacent opposite ends of the top member. A skin covers at least a major portion of the frame, while leaving the horizontal slots and the vertical slots exposed. The off-module connector includes a top bracket having a hook portion thereof shaped for detachable engagement in one of the horizontal slots on the first partition panel, a plate portion thereof positioned generally opposite the hook portion, and including at least one vertically oriented fastener aperture positioned to mate with one of the mounting apertures on the second partition panel. A first fastener is inserted through the fastener aperture in the top connector bracket, and extends into the one mounting aperture on the second panel. The off-module connector also includes a bottom connector bracket having a hook portion thereof shaped for detachable engagement in one of the vertical slots of the second partition panel, a plate portion thereof positioned generally opposite the hook portion of the bottom connector bracket, and at least one horizontally oriented fastener aperture adapted for positioning over the skin of the first partition panel at a vertical location aligned with the bottom member of the first partition panel. A second fastener is inserted into the fastener aperture on the bottom connector bracket, extends through the skin of the first partition panel, and is anchored in the bottom member of the first partition panel to securely, yet removably, mount the second partition panel on the first partition panel in a non-parallel, off-modular relationship.

Yet another aspect of the present invention is a method for detachably interconnecting partition panels in a non-parallel, off-modular relationship. The method includes providing first and second partition panels, each including a frame defined by rigidly interconnected top, bottom and opposite side members, with a plurality of horizontal slots extending along the top member, a plurality of vertical slots extending along the opposite side members, and at least two mounting surfaces disposed adjacent opposite ends of the top member. A skin covers at least a portion of the frame, while leaving the horizontal slots and the vertical slots exposed. The method further includes providing a top connector bracket having a hook portion thereof shaped for detachable engagement in one of the horizontal slots on the first partition panel, and a plate portion thereof positioned generally opposite the hook portion. The method further includes inserting the hook portion of the top connector bracket into a selected one of the horizontal slots on the first partition panel to detachably retain the same therein. The method further includes detachably connecting the plate portion of the top connector bracket with one of the mounting surfaces on the second partition. The method further includes providing a bottom connector bracket having a hook portion thereof shaped for detachable engagement in one of the vertical slots on the second partition panel, a plate portion thereof positioned generally opposite the hook portion of the bottom connector bracket, and including at least one horizontally oriented fastener aperture positioned for overlying the skin on the first partition panel at a vertical location aligned with the bottom member of the first partition panel. The method further includes inserting the hook portion of the bottom connector bracket into a selected one of the vertical slots on the second partition panel to detachably retain the same therein. Finally, the method further includes inserting a fastener into the fastener aperture in the bottom connector bracket, driving the fastener through the skin of the first partition panel, and anchoring the fastener in the bottom portion of the first partition panel to securely, yet removably, mount the first partition panel on the second partition panel in an off-modular relationship.

Yet another aspect of the present invention is a partition system of the type having at least first and second partition panels, each including a generally rectangular frame defined by rigidly interconnected top, bottom and opposite side members, with a plurality of horizontal slots extending along the top member, and vertically oriented mounting apertures disposed adjacent opposite ends of the top member and the bottom member. A skin covers at least a major portion of the frame, while leaving the horizontal slots exposed. The partition system includes an off-module connector detachably connecting the first partition panel with the second partition panel in a non-parallel, angular relationship at a location on the first partition panel between the opposite side members thereof. The off-module connector further includes a top connector bracket having a hook portion thereof detachably engaged in one of the horizontal slots on the first partition, a plate portion thereof positioned generally opposite of the hook portion, and at least one vertically oriented fastener aperture positioned to mate with a first one of the mounting apertures adjacent the top member on the second partition panel. A first fastener is inserted through the fastener aperture in the top connector bracket and is engaged in the first mounting aperture adjacent the top member on the second partition panel. The off-module connector also includes a rack having a plurality of horizontal slots extending along the length thereof, and connected with the first partition panel at a location generally below the bottom member thereof, such that the horizontal slots therein are accessible. The off-module connector also includes a bottom connector bracket having a hook portion thereof detachably engaged in at least one of the horizontal slots of the rack on the first partition panel, a plate portion thereof positioned generally opposite the hook portion of the bottom connector bracket, and including at least one vertically oriented fastener aperture positioned to mate with a second one of the mounting apertures adjacent the bottom member of the second partition panel. A second fastener is inserted into the fastener aperture in the bottom connector bracket, and is engaged in the second mounting aperture adjacent the bottom member on the second partition panel to securely, yet removably, mount the second partition panel on the first partition panel in an off-modular relationship.

Yet another aspect of the present invention is a mounting bracket for removably mounting an accessory on a partition panel having a rigid frame with opposite side members having vertical hanger slots extending along the length thereof. The mounting bracket includes first and second side bracket members, each having an upper portion thereof and a rearward portion thereof with a plurality of hooks configured for close reception in the vertical hanger slots on the opposite side members of the panel frame to detachably support the first and second side bracket members on the panel frame in a laterally spaced apart, horizontally aligned relationship. The mounting bracket also includes a back member extending between and operably connected with the upper portions of the first and second side bracket members, and having a generally rectangular back panel normally disposed at a vertical orientation, and defined by an upper edge, a lower edge, and opposite side edges, as well as an upper flange extending along the upper edge of the back panel and protruding forwardly thereof, a lower flange extending along the lower edge of the back panel and protruding forwardly thereof in a generally parallel relationship with the upper flange, and first and second side flanges extending along the opposite side edges of the back panel and protruding forwardly thereof in a generally perpendicular relationship with the upper and lower flanges. The first and second side flanges each have a forward portion thereof with a plurality of vertical support slots configured to receive and detachably retain therein a hanger portion of an associated accessory to detachably support the accessory on the mounting bracket.

Yet another aspect of the present invention is a mounting bracket assembly for removably mounting an accessory on a partition panel of the type having a rigid frame defined, at least in part, by opposite side members with vertical hanger slots extending along the length thereof. The mounting bracket assembly includes first and second side bracket members, each having a rearward portion thereof with a plurality of hooks configured for close reception in the vertical hanger slots on the opposite side members of the panel frame to detachably support the first and second side bracket members on the panel frame in a laterally spaced apart, horizontally aligned relationship, and a forward portion thereof with a plurality of vertical support slots configured to receive and detachably retain therein a hanger portion of an associated accessory to detachably support the accessory on the mounting bracket assembly. The hooks on the rearward portion of each of the first and second bracket members are disposed at an angle relative to the vertical support slots on the forward portion of each of the first and second bracket members, such that after insertion of the hooks into the vertical hanger slots in the opposite side members of the panel frame, the first and second bracket members are pivoted laterally to shift the same into an installed position, wherein the support slots on the first and second bracket members assume a forwardly facing, generally parallel relationship. The mounting bracket also includes a back member extending between the first and second bracket members, and being detachably connected therewith to retain the same in the installed position, and thereby positively prevent inadvertent dislodgement of the mounting bracket assembly from the panel frame.

Yet another aspect of the present invention is a partition panel of the type having a generally rectangular frame with opposite faces defined by rigidly interconnected top, bottom and opposite side members, and a plurality of vertical slots extending along the opposite side members. The partition panel includes an adapter assembly for horizontally dividing one of the opposite faces of the partition panel into separate upper and lower portions. The adapter assembly includes an adapter bracket extending generally horizontally between the opposite side members of the panel frame at a preselected vertical position intermediate the top member and the bottom member of the frame to define the upper and lower portions of the one face of the frame. The adapter bracket includes upper and lower skin retainer surfaces, and inwardly turned hooks at opposite ends of the adapter bracket which are engaged in the vertical slots in the opposite side members of the frame to detachably support the adapter bracket at the preselected vertical position. The adapter assembly also includes an upper skin shaped to enclose the upper portion of the one panel face, and having at least one connector received on and retained against the upper skin retainer surface of the adapter bracket to, at least in apart, removably support the upper skin on the frame. Finally, the adapter assembly includes a lower skin shaped to enclose the lower portion on the one panel face, and having at least one connector received on and retained against the lower skin retainer channel of the adapter bracket to, at least in part, removably support the lower skin on the frame.

These and other features, advantages and objects of the present invention will be further understood and appreciated by those skilled in the art by reference to the following written specification, claims and appended drawings.

DETAILED DESCRIPTION OF PREFERRED EMBODIMENT

Figure 1:
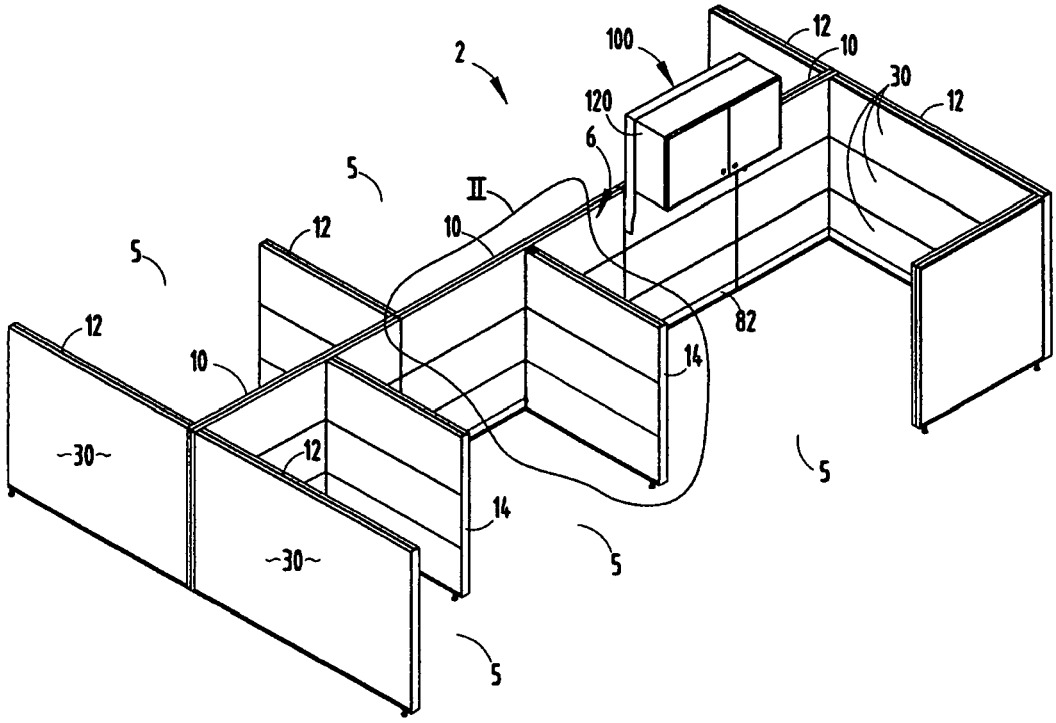
FIG. 1 is a perspective view of a partition arrangement embodying the present invention, configured to form a plurality of individual office spaces.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

A partition construction 2 embodying the present invention is shown in an office environment in FIG. 1. Nonetheless, it is specifically contemplated that the present inventive concepts can be used successfully in many different environments. For example, an exemplary partition system that can be used with the present inventive concepts is disclosed in detail in U.S. Pat. No. 6,481,163 entitled "PARTITION PANEL," filed on Oct. 20, 2000; U.S. Pat. No. 6,591,563 entitled "PANEL SYSTEM," filed on Jun. 15, 2001; U.S. Pat. No. 6,625,935 entitled "PARTITION SYSTEM WITH WORK TOOLS," filed Oct. 20, 2000; and U.S. Pat. No. 7,210,270 entitled "PARTITION SYSTEM WITH ELEVATED RACEWAY," filed Oct. 20, 2000, all of which are assigned to Steelcase Development Inc. and/or their related company, Steelcase Inc., the entire contents of each of which are hereby incorporated herein by reference.

In the illustrated partition system, the various partition panels 10, 12 and/or 14 can be configured in any one of a plurality of "on-module" or "off-module" relationships. Advantageously, this allows the partition panels 10, 12 and/or 14 to be selectively configured and reconfigured into different office arrangements 5. For example, workstations or offices 5 may be selectively configured and/or reconfigured to have different sizes, shapes and/or numbers of offices while the same partition frames 16 and partition covers 30 are used. To illustrate, FIG. 1 shows an office arrangement wherein four partition panels 12 and 14 are attached to one side of a main run of partitions 10 in a perpendicular relationship to form three offices 5, while three partition panels 12 are attached to the other side in a perpendicular relationship to form two larger offices 5. It is to be understood that any or each of the offices 5 on either side of the main run of partitions 10 or "spine wall" can be selectively made larger or smaller, and can be made to have different sizes and shapes, merely by selective rearrangement and reattachment of the partition panels 12 and/or 14. Notably, in the partition arrangements shown in FIG. 1, several of the partition panels 14 are in "off-module" locations, wherein the partition is disposed intermediate the ends of an associated spine wall partition 10. Such "off-module" partitions or panels may interfere with removing the covers 30 disposed on the face 6 of the spine wall partitions or panels 10. Thus, covers 30, disposed on the partitions that make up spine wall 10, cannot be pulled perpendicularly off of the face 6 of the spine wall in order to gain access to electrical/communication wires disposed therein. One aspect of the present off-module connector system solves this problem by allowing the off-module partition 14 to be easily removed from spine wall 10, thereby allowing access to covers 30 disposed on spine wall 10 and therefore, to the electrical/communication wires and equipment disposed therein.

With regard to FIG. 1, partition construction 2 includes a main run of partitions 10 (herein referred to as "spine wall"), and a plurality of perpendicularly attached partitions 12 and 14 (herein referred to as "fin walls"). In addition, fin wall partitions 12 and 14 can be subdivided into "on-module" partitions 12, which are interconnected to spine wall partitions 10 at the ends thereof, and "off-module" partitions 14, which are interconnected to spine wall partitions 10 intermediate the ends thereof. The partitions 10, 12 and 14 may have identical partition frames 16, or the frames may be different. For example, it is contemplated that the partitions making up the spine wall will have a high degree of utility carrying capability, while the fin wall partitions may have a lesser utility carrying capability, depending on the functional requirements of the customer.

Piercing Off-Module Connector

Figure 1A:
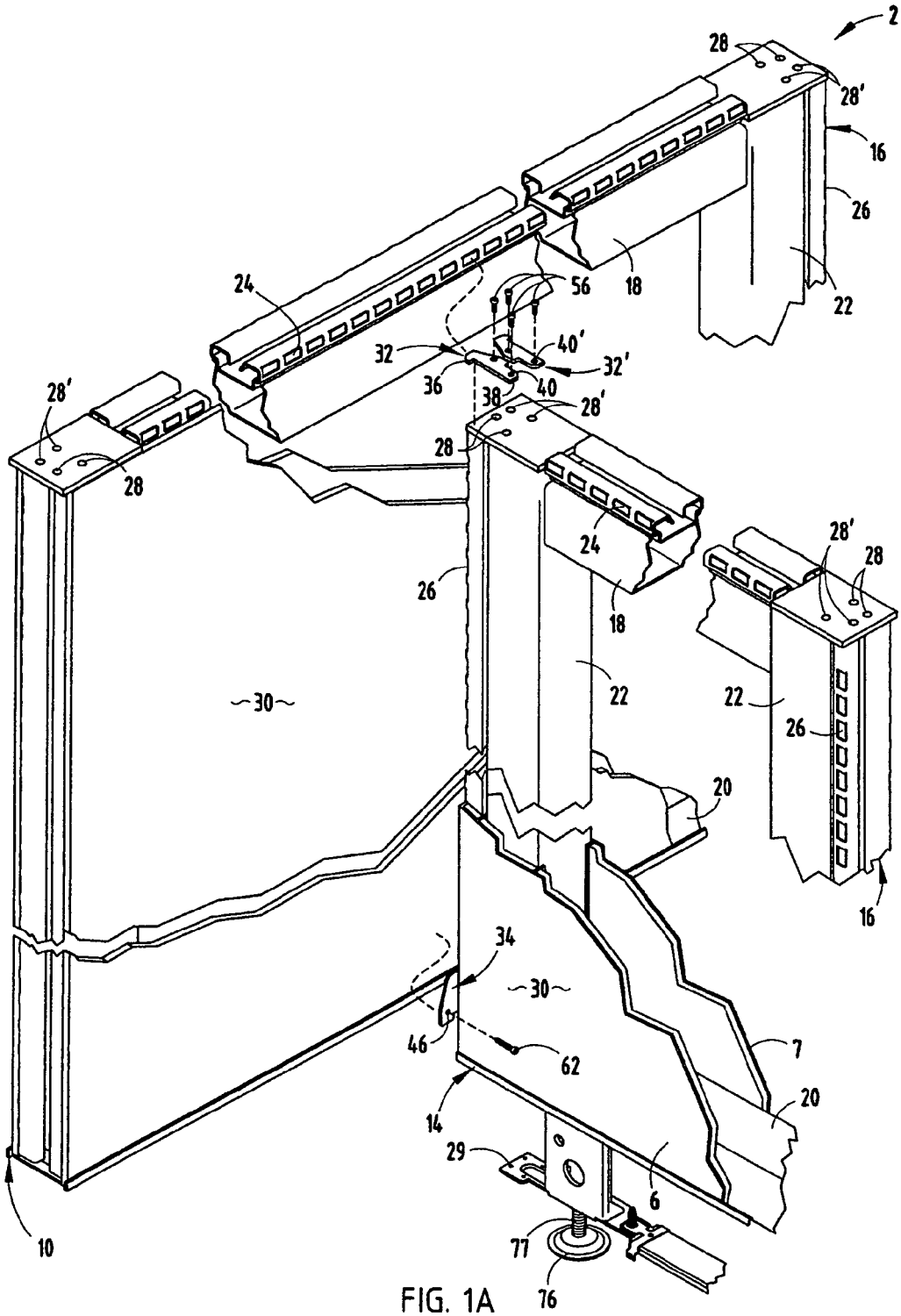
FIG. 1A is a fragmentary perspective view of section 2 of FIG. 1, showing a spine wall partition having one off-module partition attached to the spine wall partition using the first embodiment of the present invention that includes top and bottom brackets shown in a disassembled condition.
Figure 2:
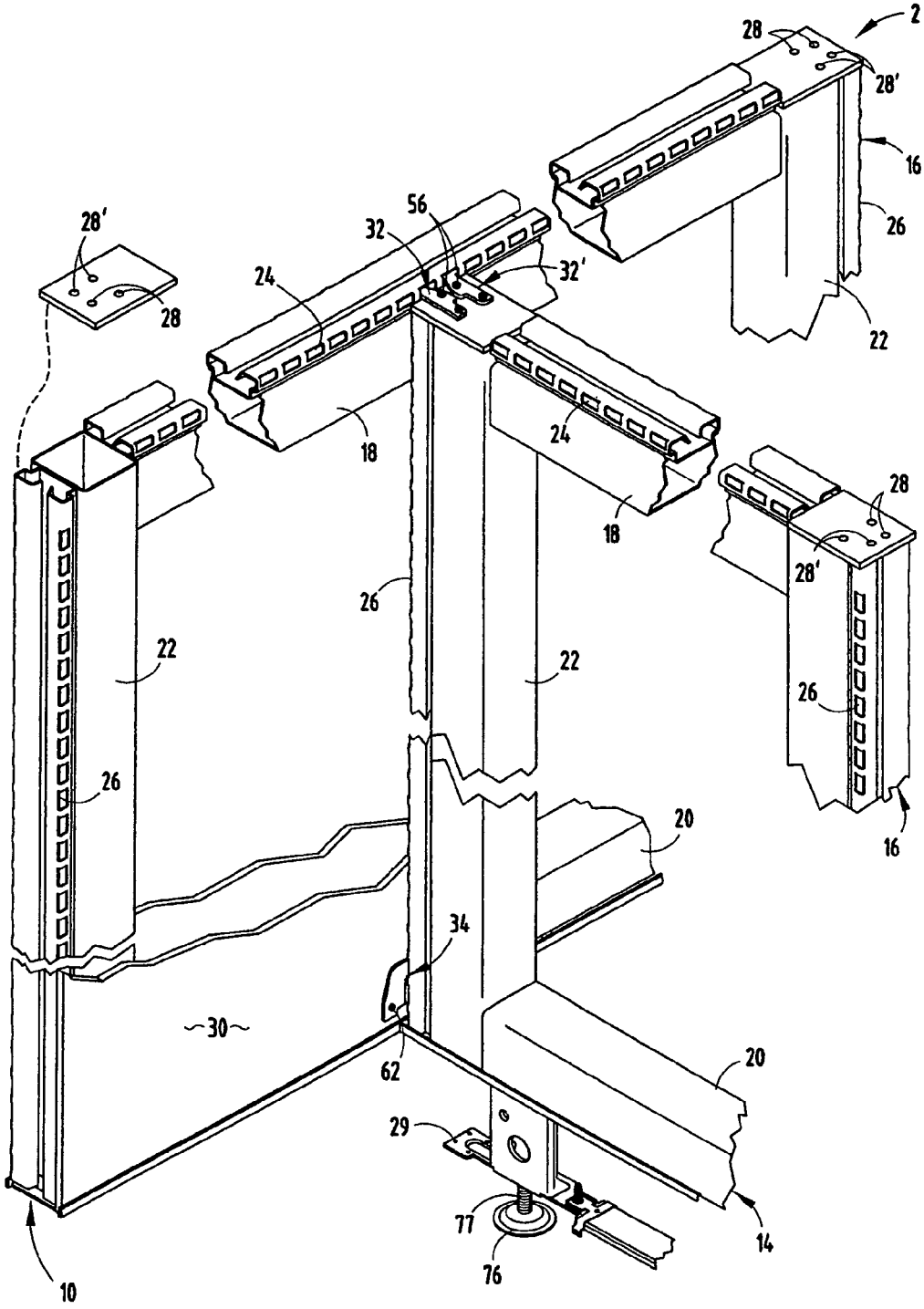
FIG. 2 is a fragmentary perspective view of the spine wall and off-module partition arrangement shown in FIG. 1, wherein the spine wall and the off-module partitions are fully assembled, and wherein portions thereof are broken away to reveal internal construction.

An off-module attachment system is illustrated in FIGS. 1A and 2, wherein partition system 2 includes at least first and second partition panels 10 and 14, respectively, each including a generally rectangular frame 16 defined by rigidly interconnected top 18, bottom 20 and opposite side members 22, with a plurality of horizontal slots 24 extending along top member 18 and a plurality of vertical slots 26 extending along opposite side members 22. At least two vertically oriented mounting apertures 28 are disposed adjacent opposite ends of top member 18, and a skin 30 covers at least a major portion of frame 16, while leaving slots 24 and 26 exposed. The off-module attachment system detachably connects first partition panel 10 with second partition panel 14 in a non-parallel, angular relationship at a location on first partition panel 10 between opposite side members 22 thereof.

The off-module attachment system shown in FIGS. 1-6A includes at least one top connector bracket 32 having a hook portion 36 detachably engaged in one of the horizontal slots 24 on top member 18 of first partition panel 10, and a plate portion 38 positioned generally opposite hook portion 36, which includes at least one vertically oriented fastener aperture 40 positioned to mate with one of the mounting apertures 28 on second partition panel 14. A first fastener 56 is inserted through fastener aperture 40 in top connector bracket 32 and is engaged in mounting aperture 28 on second partition panel 14.

The off-module attachment system shown in FIGS. 1-6A also includes a bottom connector bracket 34 having a hook portion 42 (FIG. 4) detachably engaged in one of the vertical slots 26 on the side member 22 of second partition panel 14, and a plate portion 44 positioned generally opposite hook portion 42 of bottom connector bracket 34, which includes at least one horizontally oriented fastener aperture 46 positioned to overlie skin 30 of first partition panel 10 at a vertical location which is aligned with bottom member 20 of first partition panel 10. A second fastener 62 is inserted into fastener aperture 46 in bottom connector bracket 34, extends through the skin 30 of first partition panel 10 and is anchored into bottom member 20 of first partition panel 10 to securely, yet removably, mount second partition panel 14 on first partition panel 10 in an off-modular relationship. In the illustrated embodiment, a pair of top connector brackets 32 and 32' and a pair of bottom connector brackets 34 and 34' are used in the manner shown in FIGS. 1A, 2, 5 and 6.

Figure 3:
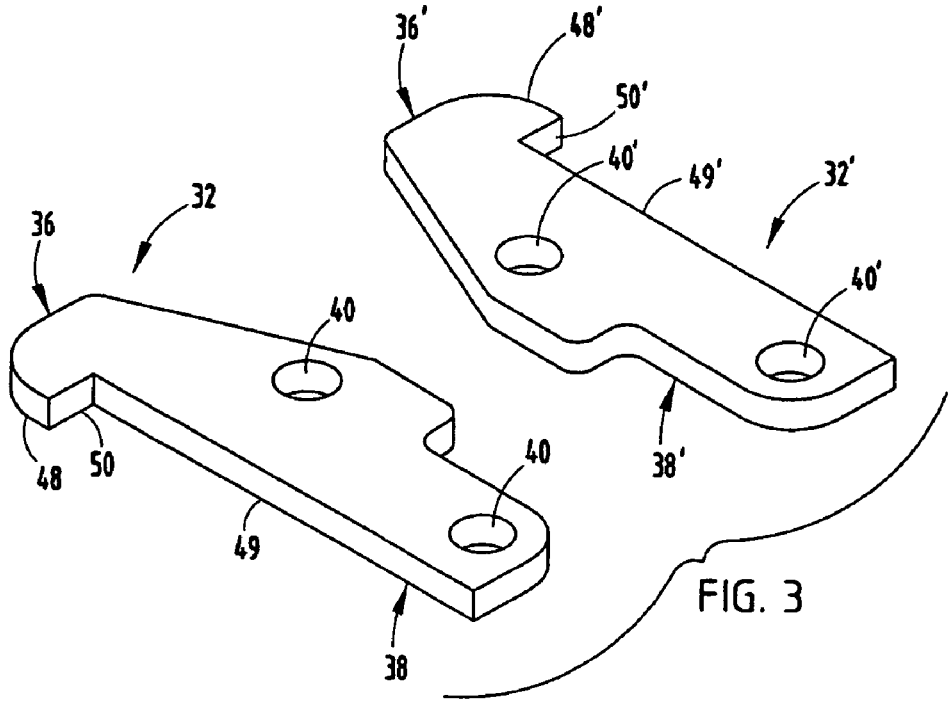
FIG. 3 is a perspective view of a pair of the top brackets.

With reference to FIG. 3, top connector bracket 32 includes a hook portion 36 which detachably engages one of said horizontal slots 24 disposed on spine wall partition 10 (as described in more detail below) and a plate portion 38 positioned generally opposite hook portion 36. Plate portion 38 includes at least one vertically oriented fastening aperture 40 which, upon installation, is positioned to mate with one of the vertically oriented mounting apertures 28 on off-module partition 14. In the illustrated embodiment, top connector bracket 32 is generally flat, wherein hook portion 36 and plate portion 38 are substantially coplanar, and plate portion 38 includes a pair of vertically oriented fastening apertures 40 spaced a predetermined distance from one another, while hook portion 36 protrudes laterally outwardly from plate portion 38 with respect to its longitudinal axis.

Figure 4:
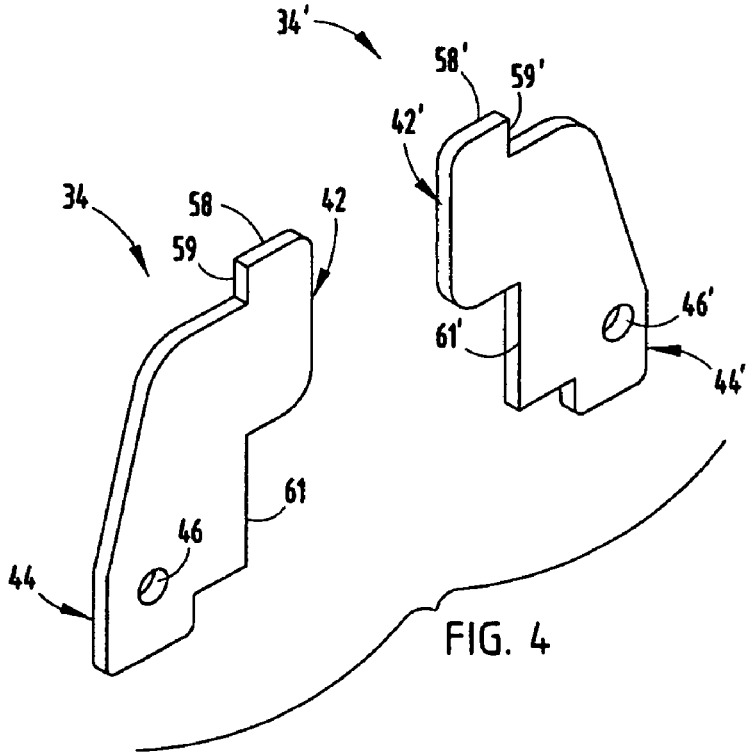
FIG. 4 is a perspective view of a pair of the bottom brackets.
Figure 5:
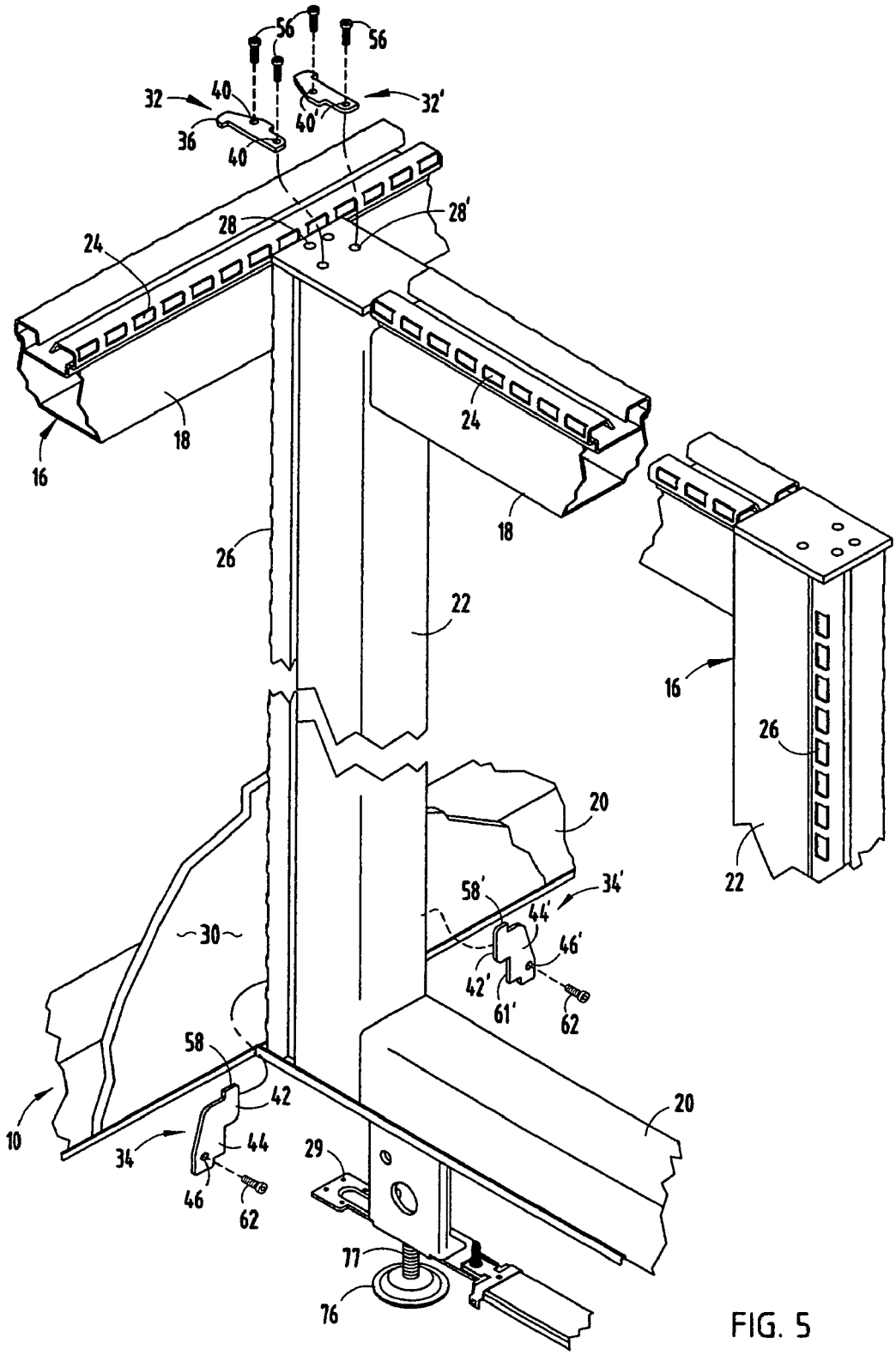
FIG. 5 is a fragmentary perspective view of FIG. 2 with the top and bottom brackets exploded therefrom.

With reference to FIG. 4, bottom connector bracket 34 includes a hook portion 42 which detachably engages one of vertical slots 26 disposed on off-module partition 14 (as described below) and a plate portion 44 positioned generally opposite hook portion 42. Plate portion 44 also includes at least one horizontally oriented fastening aperture 46. Upon installation, connector bracket 34 is positioned in a vertical slot 26 on the side member 22 of partition frame 16, such that aperture 46 overlies the skin or covering 30 on spine wall partition 10 at a vertical location on spine wall 10 which is aligned with bottom frame member 20. In the illustrated embodiment, bottom connector bracket 34 is generally flat, whereby hook portion 42 and plate portion 44 are substantially coplanar, while hook portion 42 protrudes vertically upward from plate portion 44 with respect to its longitudinal axis.

Figure 6:
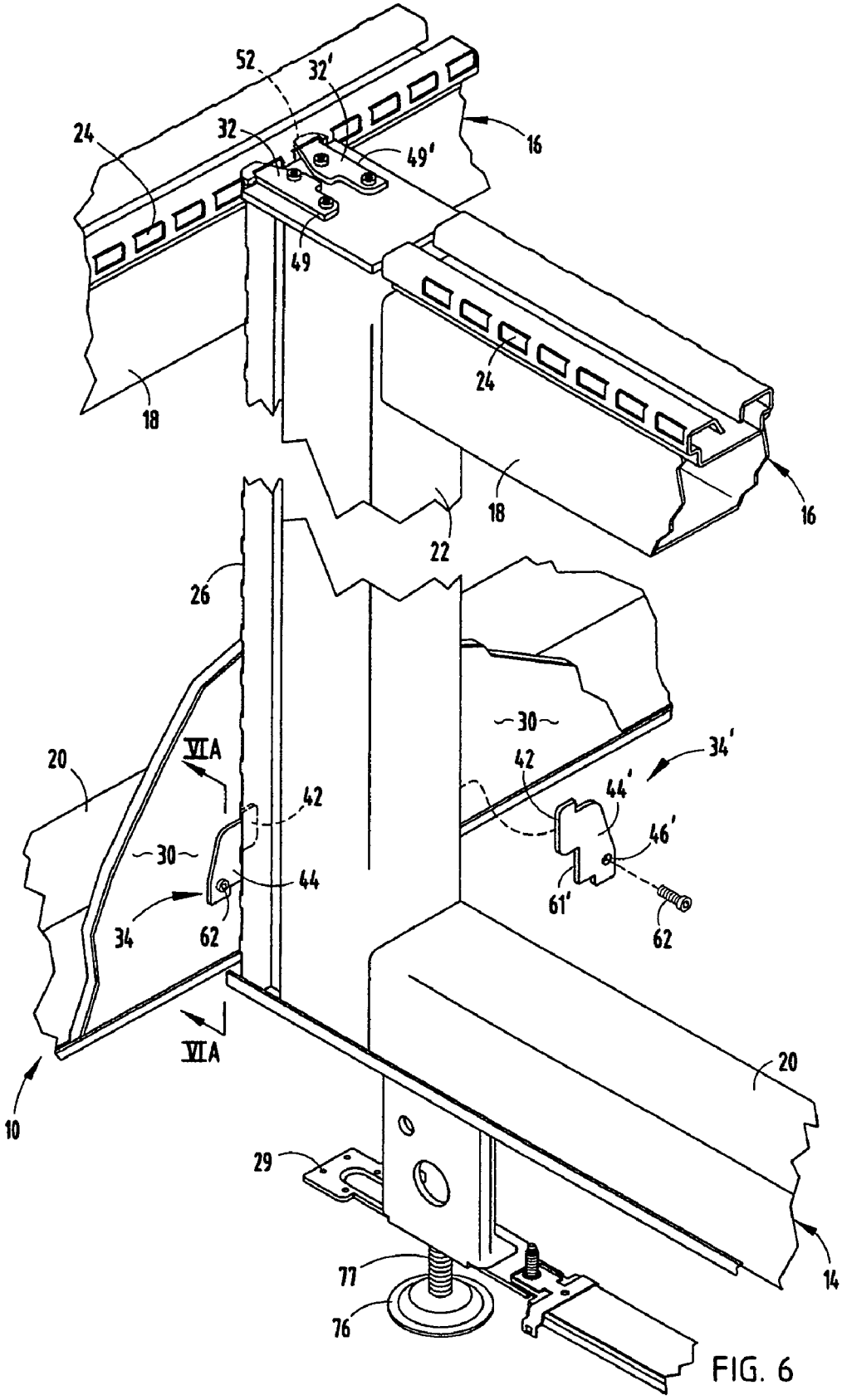
FIG. 6 is a fragmentary perspective view of the top and bottom brackets of FIG. 2.

Top off-module connector bracket 32 and bottom connector bracket 34 are installed in the following manner. It is to be understood that top off-module connector bracket 32' and bottom connector bracket 34' are installed in the same manner. As best illustrated in FIGS. 2-6, top off-module connector bracket 32 is installed by first inserting the hook portion 36 of top connector bracket 32 into one of the horizontal slots 24 on the top frame member 18 of spine wall partition 10. Hook portion 36 is inserted into one of the horizontal slots 24 by first engaging free end portion 48 into slot 24 while an edge 49 of plate portion 38 is disposed in a generally parallel manner with respect to horizontal slots 24. Top connector bracket 32 is then rotated outwardly to position the edge 50 of hook portion 36 on the inside surface 52 of the frame 16 adjacent horizontal slot 24, thereby finally positioning top connector bracket 32 such that edge 49 is disposed perpendicular to horizontal slots 24 in the manner shown in FIGS. 2 and 6. When installed in this manner, the vertically oriented fastening apertures 40 on the plate portion 38 of top connector bracket 32 are aligned with vertically oriented fastening apertures 28 on off-module partition 14 when the off-module panel 14 is positioned adjacent spine wall panel 10. A fastener 56 is inserted through apertures 40 and 28 to detachably connect plate portion 38 to off-module partition 14. For example, two threaded fasteners 56 may be used for attaching each top connector bracket 32 to partition 14. Although a single top connector bracket 32 may be used to connect off-module partition 14 and spine module 10, in the illustrated embodiment of the invention shown in FIGS. 1-10, a pair of top connector brackets 32 and 32' are used, whereby each connector bracket 32 and 32' attaches the top frame member 18 of off-module partition 14 to the side frame member 22 of spine wall partition 10, as illustrated in FIGS. 2 and 6. In this configuration, off-module partition 14 includes two pairs of vertically oriented apertures 28 and 28', and each top bracket 32 and 32' includes a pair of apertures 40 and 40' that are aligned with apertures 28 and 28', respectively. Threaded fasteners 56 are inserted therethrough to rigidly, yet detachably, retain off-module partition 14 to spine wall panel 10.

The bottom off-module connector 34 shown in FIGS. 1-6A is installed by inserting the edge 58 of the hook portion 42 into one of the vertical slots 26 of off-module partition 14. Connector bracket 34 is positioned in one of the plurality of slots 26 such that aperture 46 overlies the skin or covering 30 on spine wall panel 10 at a vertical location which is aligned with bottom frame member 20. Bottom connector bracket 34 is then rotated downwardly thereby engaging the edge 59 of hook portion 42 against the inside surface of frame member 22 adjacent vertical slots 26, whereby bottom connector bracket 34 is finally positioned such that the edge 61 is disposed parallel to and adjacent vertical slots 26 (FIG. 6). A fastener 62 is then inserted horizontally into aperture 46, driven through skin covering 30, and anchored in the bottom frame member 20 of spine wall panel 10 to securely, yet removably, mount off-module panel 14 to spine wall panel 10 in an off-module relationship. Preferably, fastener 62 is a threaded, self-piercing screw which is driven through skin covering 30 and into bottom frame member 20 for anchoring therein, without pre-drilling an associated aperture in bottom frame member 20. Although a single bottom connector bracket 34 may be used to connect off-module panel 14 and spine wall panel 10, in the embodiment of the invention illustrated in FIGS. 1-6A, a pair of bottom connector brackets 34 and 34' are used, wherein each connector bracket attaches side member 22 of off-module panel 14 to the face of spine wall panel 10, as illustrated in FIG. 2. In this configuration, each bottom bracket 34 and 34' includes apertures 46 and 46' that are positioned over skin 30, and vertically aligned over bottom frame member 20, whereby threaded fasteners 62 are inserted thereto and through skin 30, and into frame member 20, thereby rigidly, yet detachably, retaining off-module panel 14 to spine wall panel 10.

As noted above, connector brackets 32, 32', 34 and 34' are assembled to off-module panel 14 and spine wall panel 10 by first installing the hook portions 36 and 36' on top connector brackets 32 and 32' into horizontal slots 24 of spine wall panel 10. Off-module panel 14 is then moved into position, such that apertures 28 and 28' on off-module panel 14 are aligned with the apertures 40 and 40' on brackets 32 and 32'. Fasteners 56 are threadingly and collinearly inserted through each respective aperture, thereby retaining the top portion of off-module panel 14 to the top portion of spine wall panel 10. The hook portions 42 and 42' of bottom brackets 34 and 34' are then inserted into opposite vertical slots 26 on opposite sides of off-module panel 14 in a location so that apertures 46 and 46' are positioned over cover member or skin 30 adjacent bottom frame member 20 of spine wall 10. A pair of self-piercing fasteners 62 are inserted through apertures 46 and 46', through skin 30 and into bottom frame member 20, thereby securing the bottom portion of off-module panel 14 to spine wall panel 10. Of course, a single top or bottom bracket 32 and 34, respectively, may be used. Further, brackets 32, 32', 34 and 34' may be used either alone or in conjunction with one another to secure spine wall panel 10 and off-module panel 14. Although the above-described process describes a particular sequence of events, the sequence may be changed as the specific requirements dictate.

Top connector brackets 32 and 32', along with bottom connector brackets 34 and 34', may be fabricated from numerous materials. Generally a rigid material is used, such that the brackets are capable of securely and rigidly connecting spine wall panel 10 to off-module panel 14. Such materials are commonly known within the art and may include, but are not limited to, plastics, metals, ceramics and/or composites thereof. In the illustrated embodiment, steel is used. Additionally, the method of fabricating brackets 32, 32', 34 and 34' may be varied, and although the preferred embodiment is stamped, this is not meant to be limiting in any manner, and the brackets may be fabricated from any known method, including machining, stamping, molding or the like.

Non-Piercing Off-Module Connector

A second embodiment of the off-module attachment system is illustrated in FIGS. 7-10, wherein partition system 2 (FIG. 7) includes at least first and second partition panels 10 and 14, which are identical to previously described partition panels 10 and 14 (FIGS. 1-6A). The off-module attachment system shown in FIGS. 7-10 includes a pair of top connector brackets 32 and 32', which are identical to those previously described with respect to the embodiment shown in FIGS. 1-6A. However, the previously described bottom connector brackets 34 and 34' are replaced by a rack 64, having a plurality of horizontal slots 68 extending along the length thereof. Rack 64 is connected with first partition panel 10 at a location generally below bottom member 20, such that horizontal slots 68 remain accessible. Bottom connector bracket 66 includes a hook portion 84 detachably engaged in at least one of horizontal slots 68 of rack 64 on first partition panel 10, and a plate portion 86 positioned generally opposite hook portion 84, which includes at least one vertically oriented fastener aperture 90 positioned to mate with a second one of said mounting apertures 29 adjacent bottom member 20 of second partition panel 14. A fastener 98 is inserted into fastener aperture 90 in bottom connector bracket 66, and is engaged in mounting aperture 29 adjacent bottom member 20 on second partition panel 14 to securely, yet removably, mount second partition panel 14 on first partition panel 10 in an off-modular relationship.

As best illustrated in FIGS. 7-10, rack 64 includes a plurality of horizontal slots 68 extending along the length thereof and at least one mounting flange 70 including an aperture 71. In one preferred embodiment, rack 64 is generally L-shaped with horizontal slots 68 disposed along one leg 72 and a pair of mounting flanges 70, each including an aperture 71, disposed along a generally perpendicular leg 73. Slots 74 and 75 are disposed at opposite ends of leg 72 and are adapted to be disposed around posts 77 of glides 76 positioned at opposite ends of partitions 10, 12 and/or 14. In the illustrated embodiment, rack 64 is disposed on spine wall panel 10 below bottom frame member 20, thereby releasably connecting the frames of off-module panel 14 and spine wall panel 10 in an off-module configuration.

Figures 6A, 7:
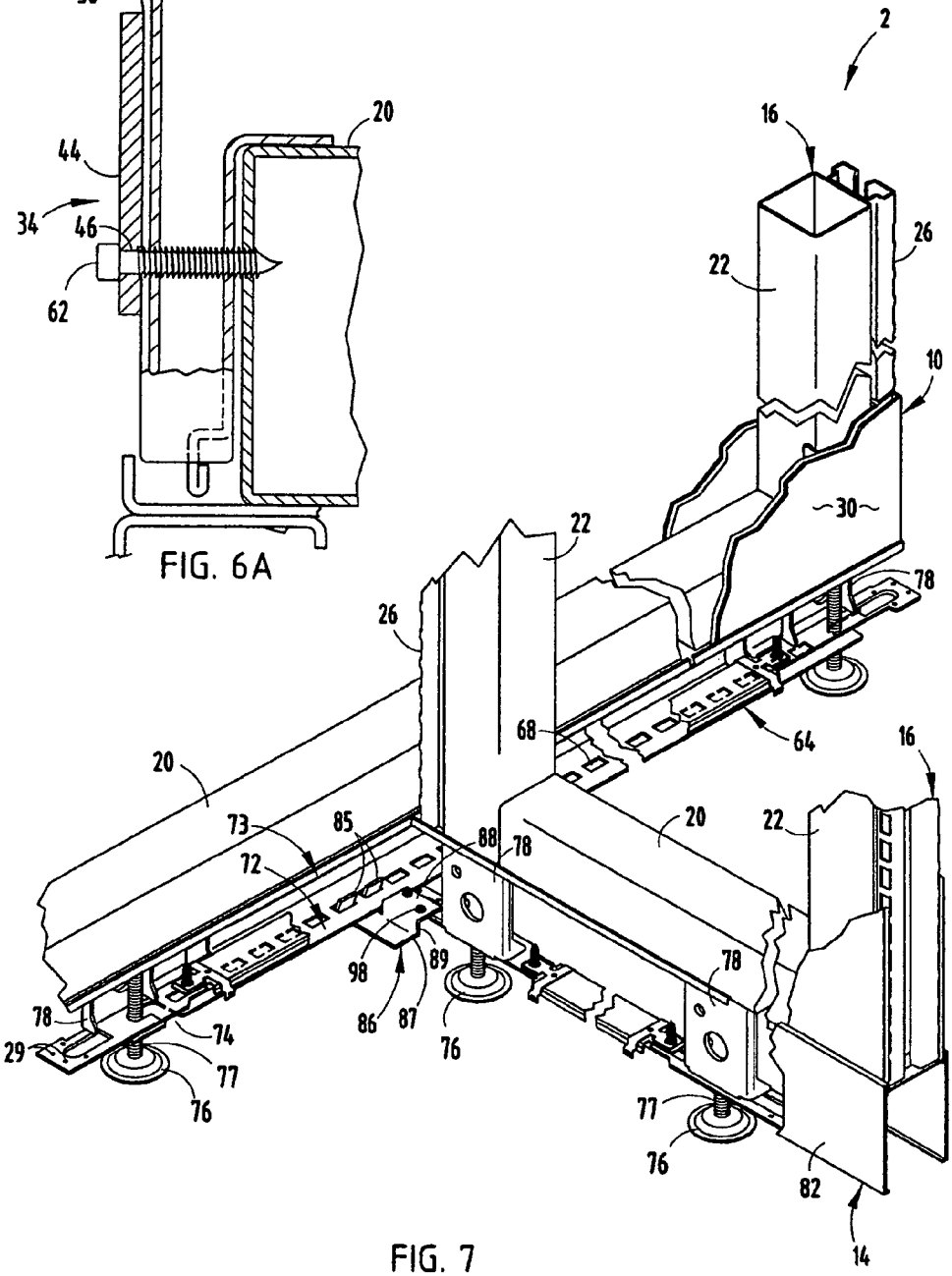
FIG. 6A is a fragmentary vertical cross-sectional view of one of the bottom brackets attached to an associated panel frame.
FIG. 7 is a fragmentary perspective view of another embodiment of the present invention, having a bottom bracket including a rack portion and a clip portion.
Figure 8:
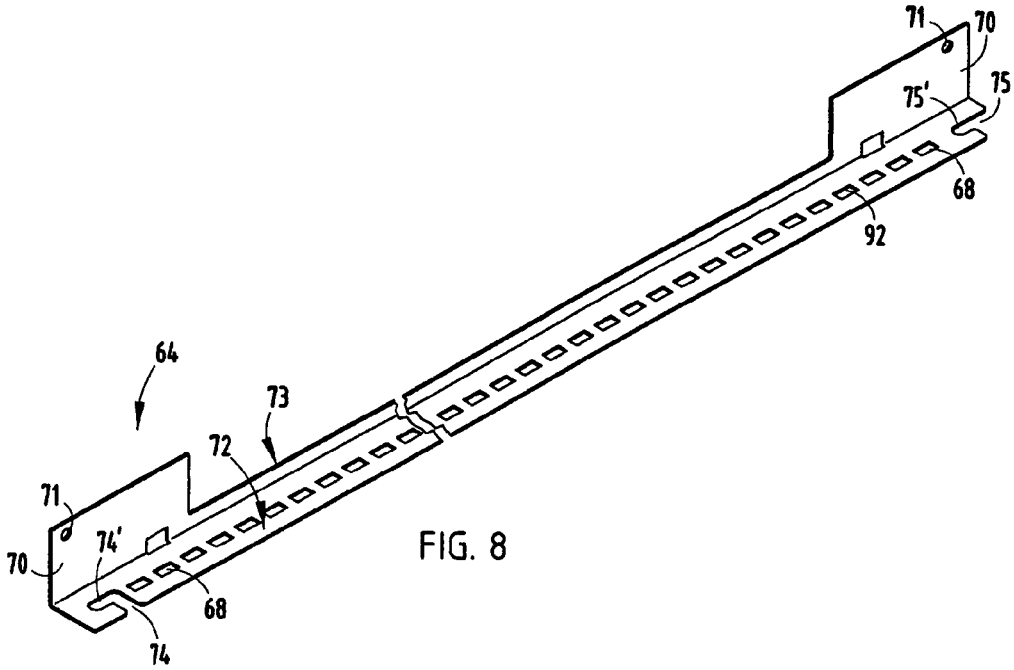
FIG. 8 is a perspective view of the rack of FIG. 7.

With reference to FIG. 7, rack 64 is disposed on spine wall panel 10, such that rack leg 72 and corresponding horizontal slots 68 are positioned generally along the centerline of spine wall panel 10, which is to receive off-module panel 14. In this manner, rack 64 is non-handed, and can be used on either side of the panel 10. The installation of rack 64 is accomplished by positioning slots 74 and 75 around the posts 77 on glides 76, and shifting rack 64 longitudinally to engage slot recesses 74' and 75' of slots 74 and 75, respectively. When shifted longitudinally, recesses 74' and 75' are disposed around posts 77, and rack 64 is prevented from being removed from spine wall panel 10 without first longitudinally shifting rack 64 in the direction opposite to the direction rack 64 was shifted when rack 64 was installed. In this manner, slots 68 are accessible from the side of spine wall panel 10, which is to receive off-module panel 14. In this configuration, leg 73 and mounting flanges 70 are vertically disposed behind glides 76, opposite the side of spine wall panel 10, which is to receive off-module panel 14, and apertures 71 of mounting flanges 70 are aligned with apertures 79 on feet 78, thereby allowing fasteners 80 to be inserted therethrough for retaining rack 64 on spine wall panel 10. A cover 82 may be positioned along the base of spine wall panel 10 to conceal at least a major portion of rack 64. In this manner, horizontal slots 68 are disposed below frame member 20 and therefore, even with a cover 82 installed on spine wall panel 10, the horizontal slots 68 are accessible for receiving bracket 66 in the manner described below.

Figure 9:
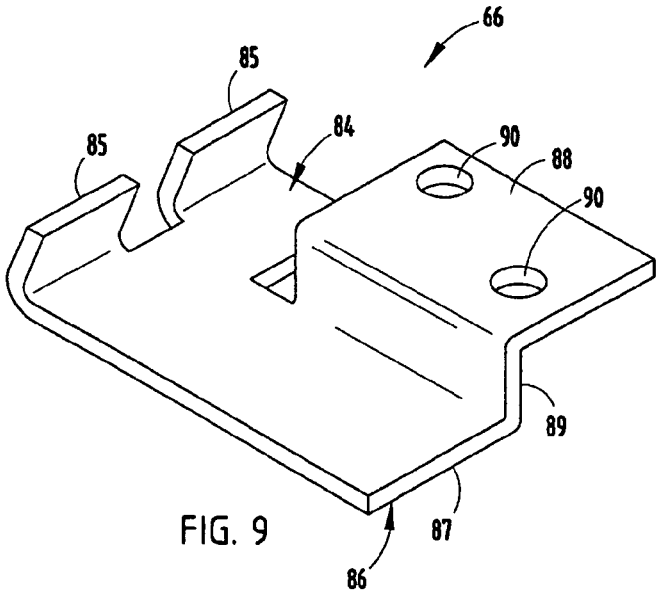
FIG. 9 is an enlarged perspective view of the clip of FIG. 7.
Figure 10:
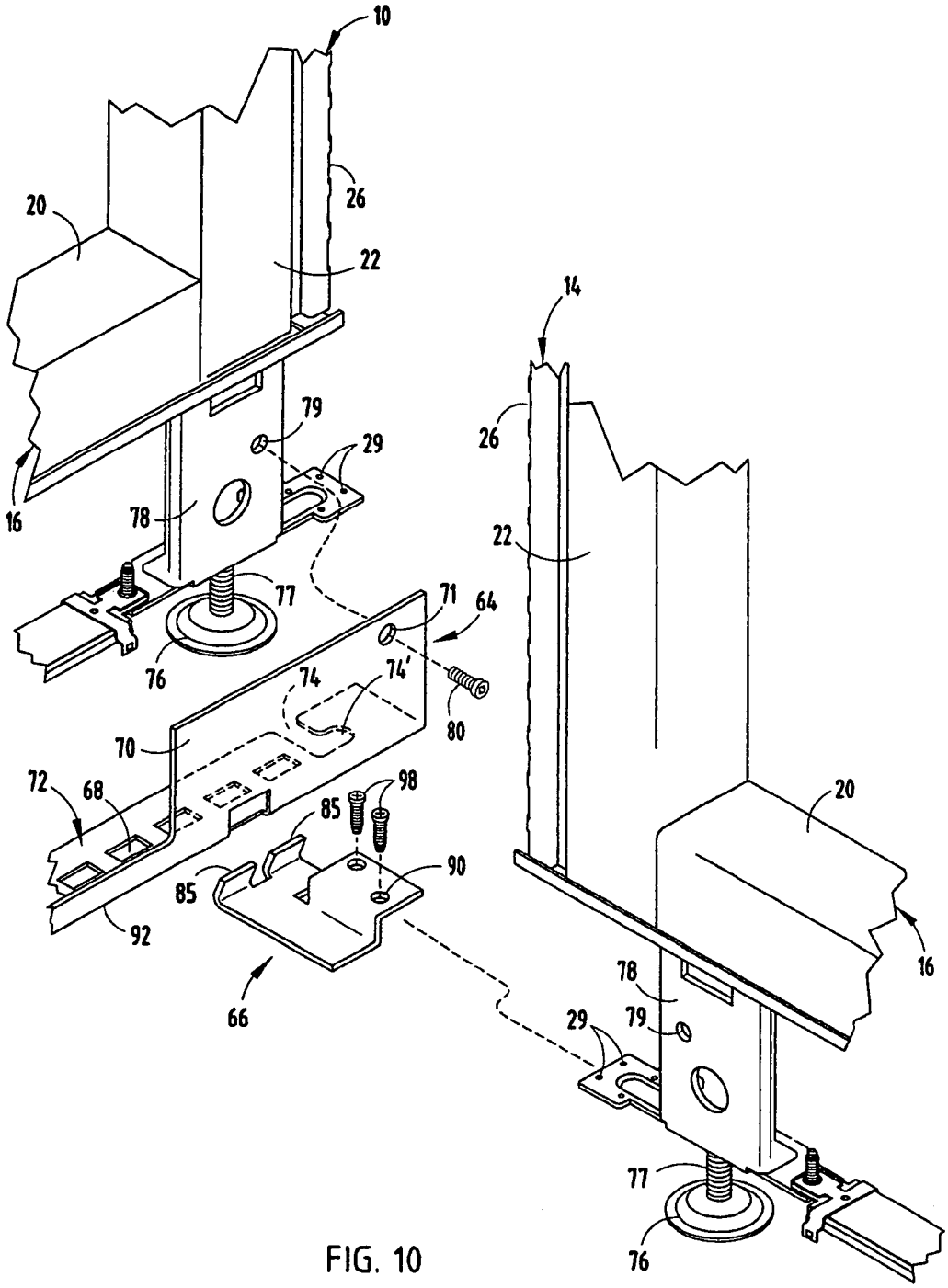
FIG. 10 is an exploded fragmentary perspective view of the bracket and clip of FIG. 7.

With reference to FIG. 9, bottom connector bracket 66 includes a hook portion 84 and a plate portion 86. In the illustrated embodiment, a pair of hooks 85 are disposed on hook portion 84 and are turned upwardly therefrom. Plate portion 86 further includes a first portion 87 and a second portion 88. First portion 87 is disposed generally coplanar with hook portion 84, while second portion 88 is generally parallel to first portion 87, vertically raised therefrom, and connected by a leg 89. Second portion 88 includes a pair of apertures 90.

Hooks 85 are detachably engaged within horizontal slots 68, as illustrated in FIG. 7, wherein each of the pairs of hooks 85 engage a single slot 68. This is accomplished by angling plate portion 86 of bracket 66 upwardly and inserting the pair of hooks 85 through a bottom surface 92 of a pair of horizontal slots 68 and then rotating plate portion 86 downwardly, thereby positioning bottom connector bracket 66 in a generally horizontal orientation. A pair of fasteners 98 are inserted through apertures 90 and into a pair of vertically oriented mounting apertures 29, disposed adjacent bottom frame member 20 of off-module partition 14, thereby rigidly connecting off-module panel 14 to spine wall panel 10.

In the illustrated embodiment, the bracket assembly is utilized to install an off-module panel 14 to a spine wall panel 10 in the following manner. As with the first embodiment (FIGS. 1-6A), the second embodiment (FIGS. 7-10) utilizes a pair of top connector brackets 32 and 32' in the manner described above. However, the bottom connector bracket, which includes rack portion 64 and bracket portion 66, does not cause the skin 30 of spine wall panel 10 to be pierced in order to be affixed thereto. In the FIGS. 7-10 embodiment, after top brackets 32 and 32' are installed, a single rack 64 is installed horizontally below the bottom frame member 20 of spine wall panel 10, and a single bracket 66 is attached thereto in the manner described above. The off-module panel 14 is then brought into position, and the top portion of panel 14 is secured in the manner described above with regard to the first embodiment (FIGS. 1-6A). The bottom portion of partition 14 is secured by inserting threaded fasteners 98 through apertures 90 of bracket 66, and into the corresponding apertures 29 disposed adjacent lower frame member 20 of the off-module panel 14 (FIG. 7). This secures the bottom portion of off-module panel 14 to spine wall panel 10. Of course, a single top bracket 32 may be used and further, although the above-described process describes a particular sequence of steps, the sequence may be changed as the specific requirements dictate.

Rack 64 and bottom connector bracket 66 may be fabricated from numerous materials as described previously. In the illustrated embodiment, rack 64 and bottom connector bracket 66 are fabricated by bending a stamped sheet of steel. However, this is not meant to be limiting in any manner, and rack 64 and brackets 66 may be fabricated from any known method and from any known material as the specific requirements dictate.

Accessory Up-Mount Bracket

Figure 11:
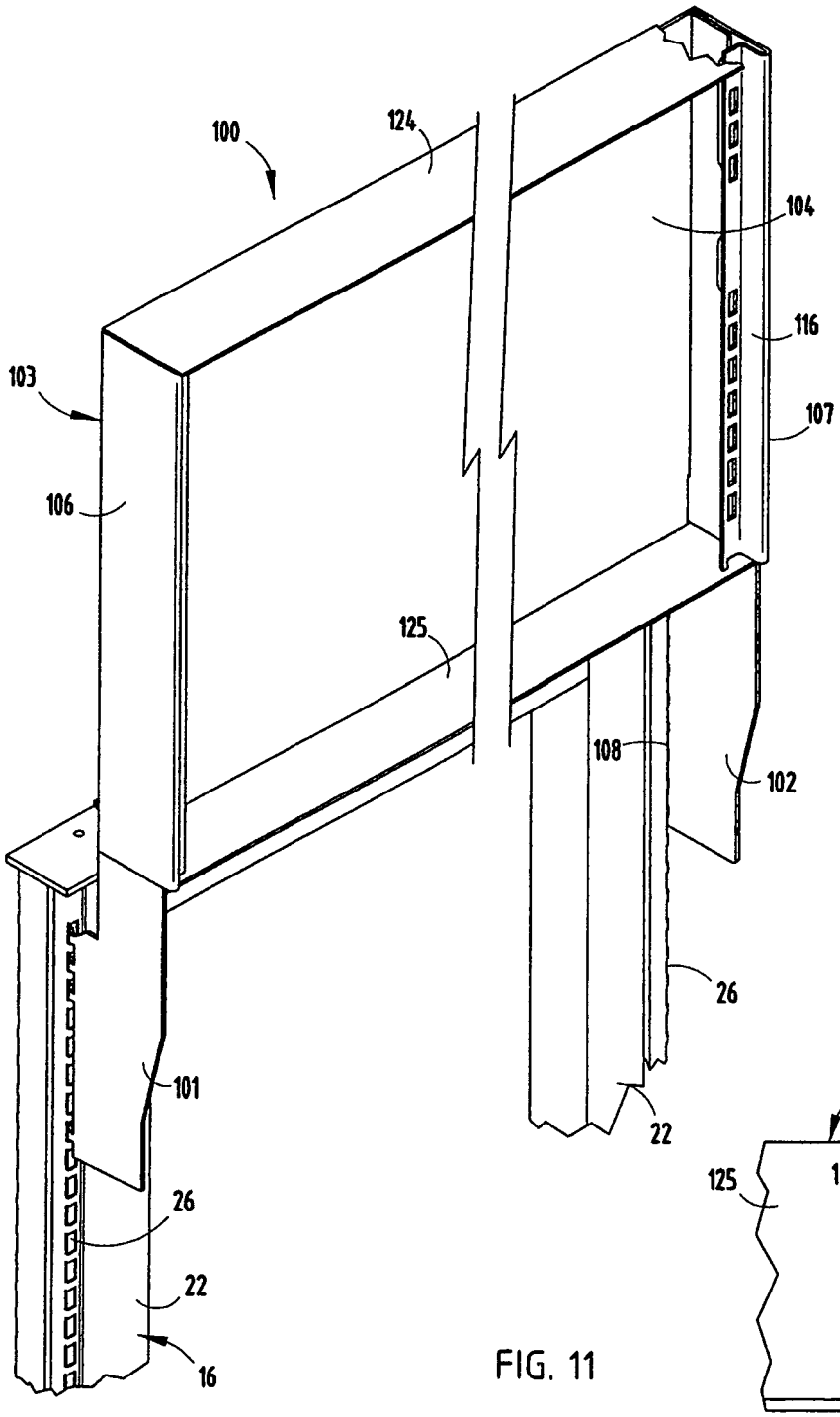
FIG. 11 is a fragmentary perspective view of another embodiment of the present invention, comprising an up-mount bracket installed on a partition panel.
Figure 12:
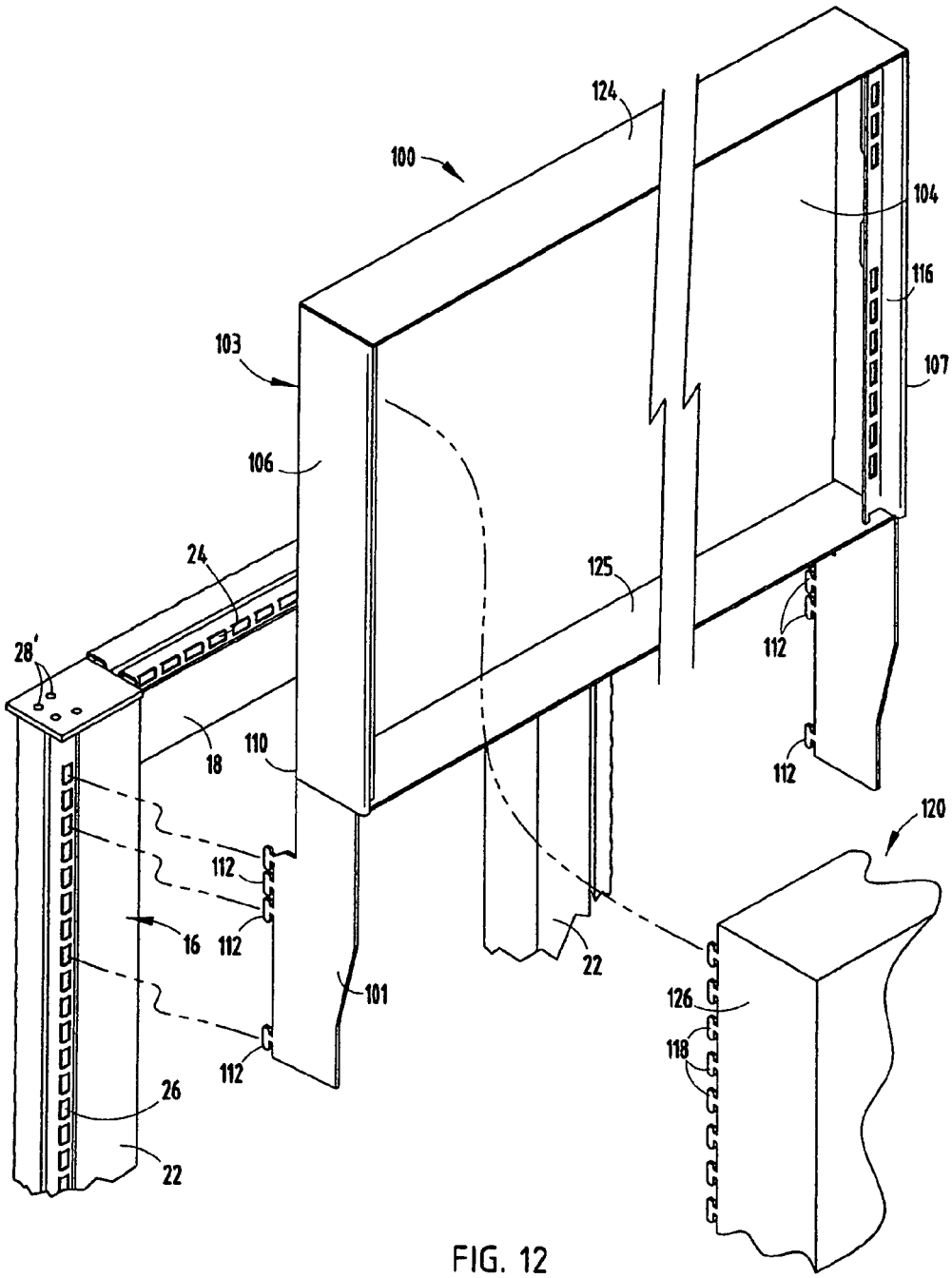
FIG. 12 is an exploded fragmentary perspective view of the up-mount bracket of FIG. 11, including an accessory exploded therefrom.
Figure 13:
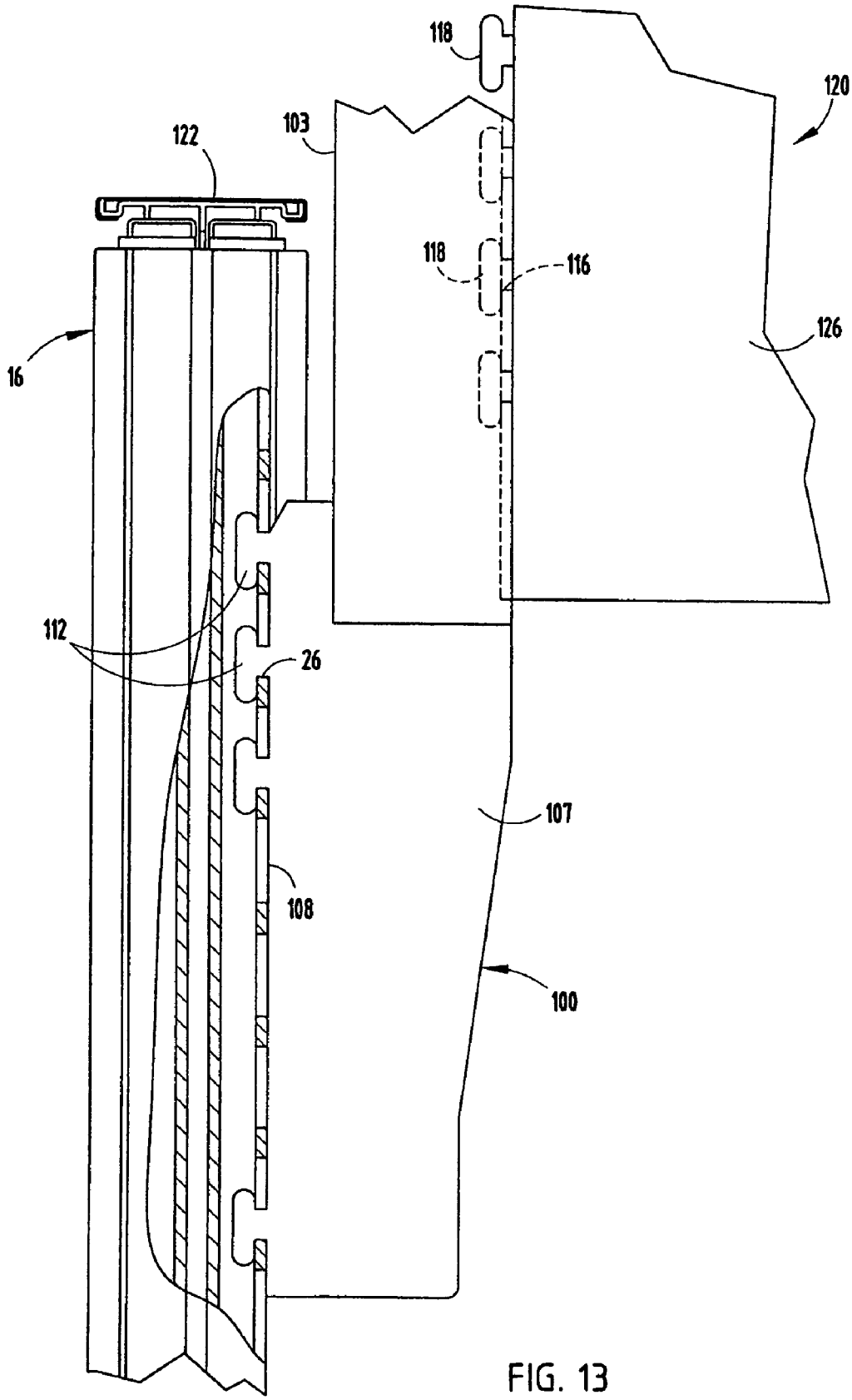
FIG. 13 is a fragmentary cross-sectional view of the up-mount bracket of FIG. 11 installed on a partition frame and including an associated accessory attached thereto.

With reference to FIGS. 11-13, an accessory up-mount bracket 100 is illustrated which removably mounts an accessory, such as a storage bin, shelf or the like, on the vertically disposed slots of partition panels 10, 12 and/or 14 of the type described above as having a rigid frame 16 defined, at least in part, by opposite side members 22 with vertical hanger slots 26 extending along the length thereof. Up-mount bracket 100 includes first and second side bracket members 101 and 102, respectively, each having a rearward portion 108 with a plurality of hooks 112. Hooks 112 are configured for close reception in the vertical hanger slots 26 on opposite side members 22 of panel frame 16 to detachably support the first and second side bracket members 101 and 102 on panel frame 16 in a laterally spaced apart, horizontally aligned relationship. Up-mount bracket 100 also includes a back member 103 extending between and operably connected with the upper portions of first and second side bracket members 101 and 102. Back member 103 has a generally rectangular back panel 104 normally disposed in a vertical orientation, and defined by an upper edge, a lower edge and opposite side edges. Back member 103 has an upper flange 124 extending along the upper edge of back panel 104, and protruding forwardly thereof. Back member 103 also includes a lower flange 125 extending along the lower edge of back panel 104, and protruding forwardly thereof in a generally parallel relationship with upper flange 124. Back member 103 also has first and second side flanges 106 and 107 extending along the opposite side edges of back member 103, and protruding forwardly thereof in a generally perpendicular relationship with the upper and lower flanges 124 and 125. The first and second side flanges 106 and 107 each have a forward portion thereof with a plurality of vertical support slots 116 configured to receive and detachably retain therein hooks 118 on the hanger portion 126 of an associated accessory 120 to detachably support the accessory 120 on up-mount bracket 100.

First and second side bracket members 101 and 102, respectively, have generally the same configuration. Therefore, only first side bracket member 101 will be discussed in detail, and second side bracket member 102 shall be understood to have the same features, functions and configurations, unless otherwise noted. First side bracket member 101 includes an upper portion and a lower portion. The rear edge 108 on the lower portion of first side bracket member 101 extends beyond the rear edge on the upper portion, and includes a plurality of outwardly disposed hooks 112. Hooks 112 are configured for close reception in the vertical hanger slots 26 of partitions 10, 12 and/or 14 to detachably support side bracket members 101 and 102 in a laterally spaced apart, horizontally aligned relationship.

Figure 11A:
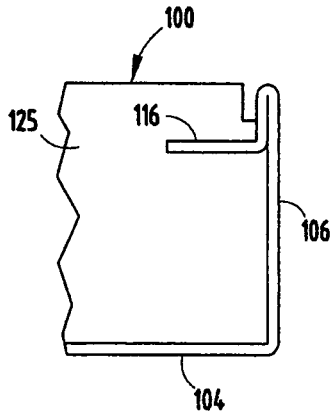
FIG. 11A is a fragmentary top plan view of the up-mount bracket of FIG. 11.

In the embodiment illustrated in FIGS. 11-13, back panel 103, upper flange 124, lower flange 125, and the first and second side flanges 106 and 107 are all integrally interconnected to define a box-shaped receptor configured to receive a rear portion of the accessory 120 therein. More specifically, back member 103 is preferably stamped from a single sheet of metal, such as steel or the like. As best illustrated in FIG. 11A, the outer edges of the first and second side flanges 106 and 107 are doubled over, and then bent inwardly to form a generally L-shaped configuration. The vertical support slots 116 are positioned along the length of the inwardly extending portions of first and second side flanges 106 and 107. The upper portions of first and second side bracket members 101 and 102 are inserted through the slits formed between the free ends of lower flange 125 and first and second side flanges 106 and 107, and extend upwardly along the interior surfaces of first and second side flanges 106 and 107. In the illustrated example, the upper portions of first and second side bracket members 101 and 102 are spot welded to the first and second side flanges 106 and 107 of back member 103 to rigidly interconnect first and second side bracket members 101 and 102 with back member 103.

As best illustrated in FIG. 12, up-mount bracket 100 is manufactured to have the same general width as the partition panels 10, 12, 14 to which it is to be installed. More specifically, the hooks 112 on side brackets 101 and 102 are spaced to correspond and align with the vertical slots 26 disposed along opposite side edges of partitions or panels 10, 12 and/or 14. Up-mount bracket 100 is installed on panels 10, 12 and/or 14 by positioning the hooks 112 of side brackets 101 and 102 within vertical slots 26, whereby up-mount bracket 100 is securely retained on the partition in a generally horizontal manner.

As best illustrated in FIG. 13, accessory 120 includes rearwardly facing hanger portions 126 disposed on opposite sides. Hanger portions 126 include hooks 118 that, when disposed within the vertical slots 116 on back member 103, securely retain accessory 120, thereby supporting accessory 120 from the partitions 10, 12 and/or 14 in a cantilevered fashion. In the illustrated embodiment, hooks 112 of up-mount 100 are disposed on side bracket members 101 and 102 toward a lower or bottom end thereof, while vertical slots 116 are disposed above hooks 112 and extend to an upper or top end thereof. In this manner, hooks 112 can be installed on partitions or panels 10, 12 and/or 14, while vertical slots 116 extend above the top member 122 of the partition, thereby allowing the accessory to be positioned above top 122 of the partition panel. Of course, first and second bracket members 101 and 102 may be disposed lower on the partition, whereby the accessory 120 can be disposed below the top edge of the partition. For example, in one embodiment, accessory 120 is a cabinet or storage bin that is supported above the top 122 of the partition panel to which up-mount bracket 100 is installed. Of course, various other accessories may be supported or suspended from up-mount bracket 100 including, but not limited to, worksurfaces, shelving, storage bins, lighting and the like.

Up-mount bracket 100 may be fabricated from numerous materials. Generally a rigid material is used, such that bracket 100 is capable of securely and rigidly connecting accessory 120 to panels 10, 12 and/or 14. Such materials are commonly known within the art and may include, but are not limited to, plastics, metals, ceramics and/or composites thereof. In a preferred embodiment, steel is used. Additionally, the method of fabricating up-mount bracket 100 may be varied, and although the illustrated embodiment is fabricated by a stamping, bending and welding process, this is not meant to be limiting in any manner, and the brackets may be fabricated from any known method, including machining, molding or the like.

Segmented Skin Adapter

Figure 13A:
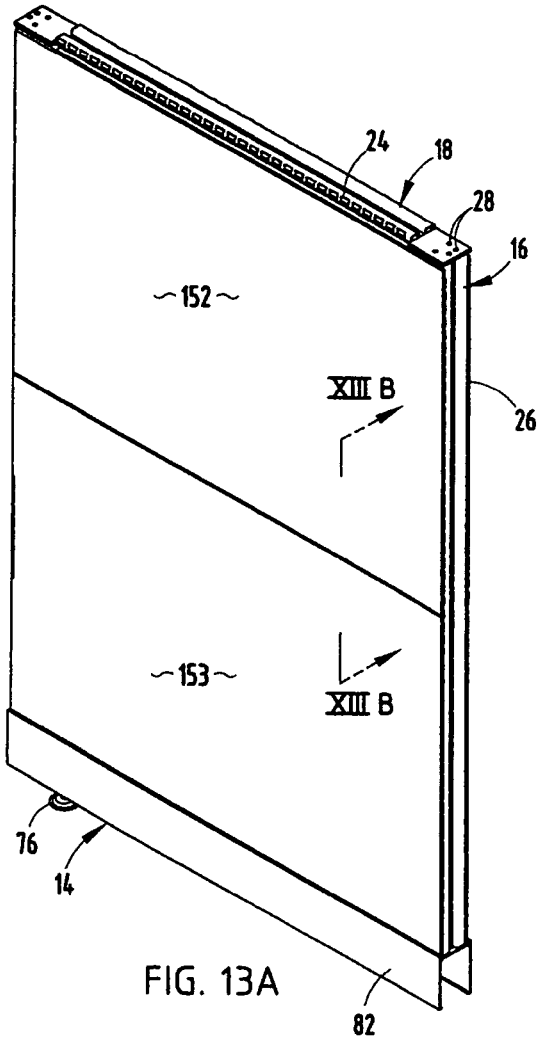
FIG. 13A is a perspective view of another embodiment of the present invention, comprising a segmented skin adapter.
Figure 13B:
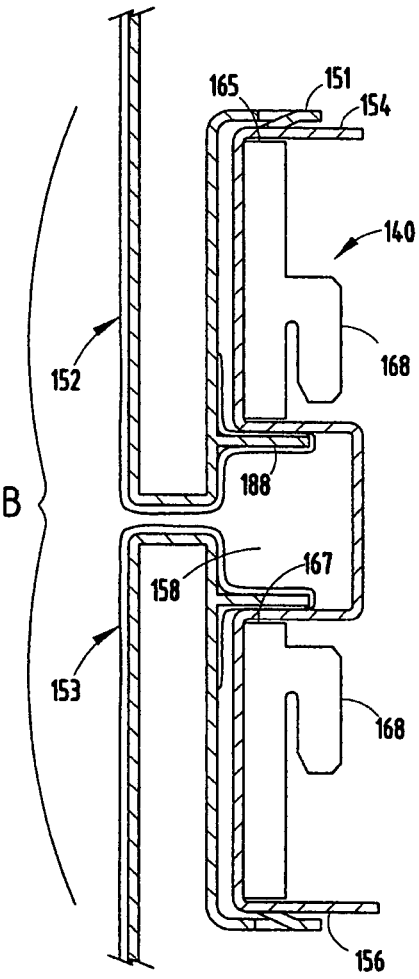
FIG. 13B is a vertical cross-sectional view of the segmented skin adapter of FIG. 13A.
Figure 14:
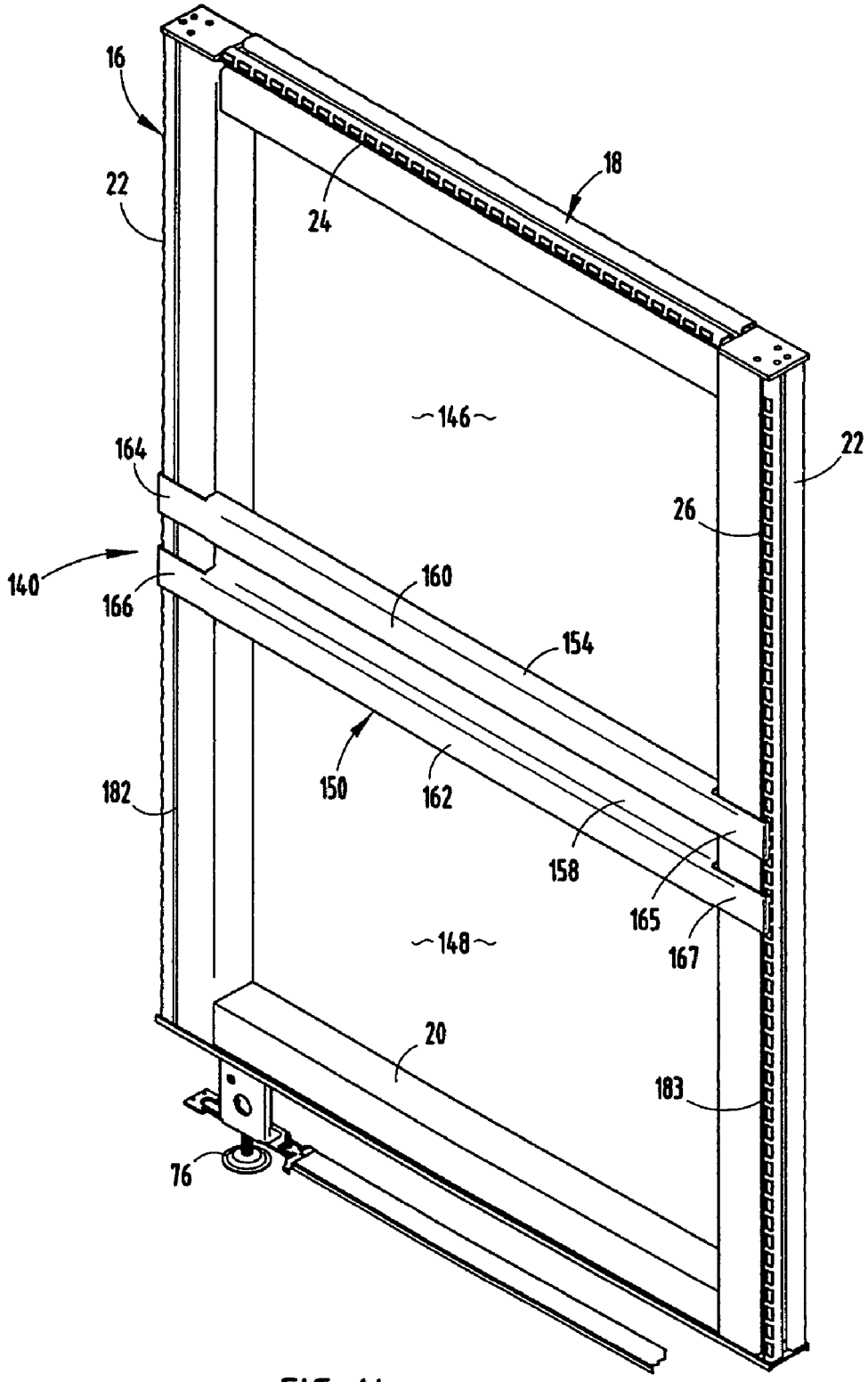
FIG. 14 is a perspective view of a bracket portion of the segmented skin adapter shown installed on a partition panel frame.
Figure 15:
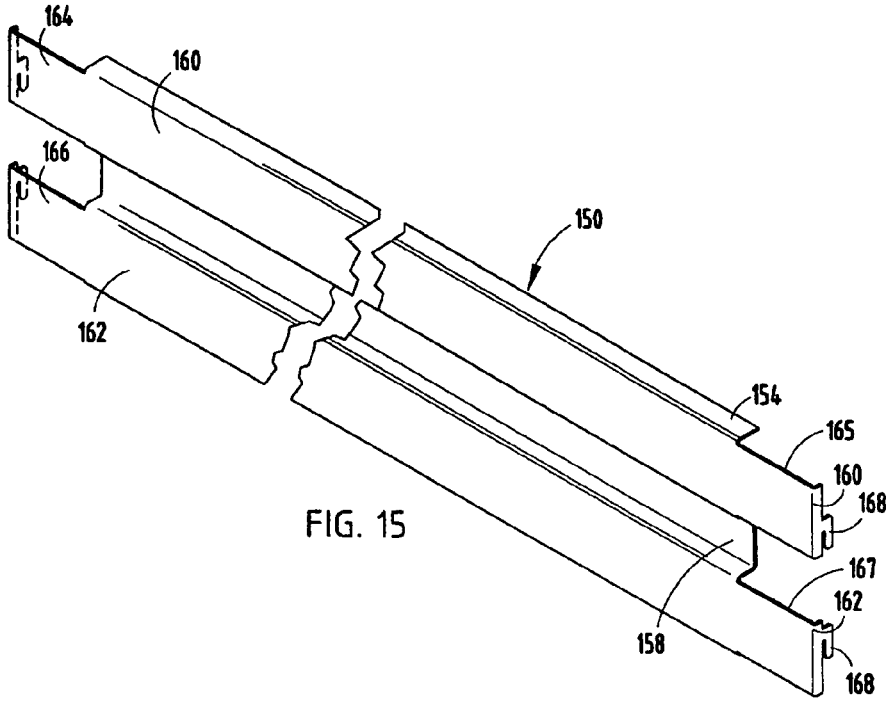
FIG. 15 is a front perspective view of the bracket of FIG. 14.
Figure 16:
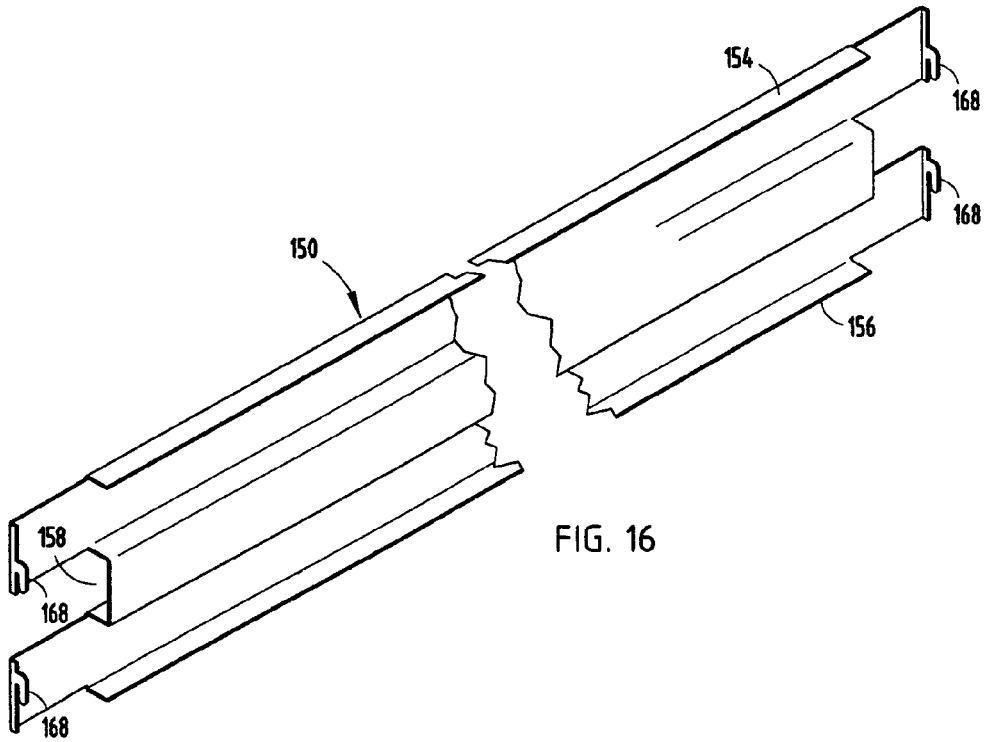
FIG. 16 is a rear perspective view of the bracket of FIG. 14.
Figure 17:
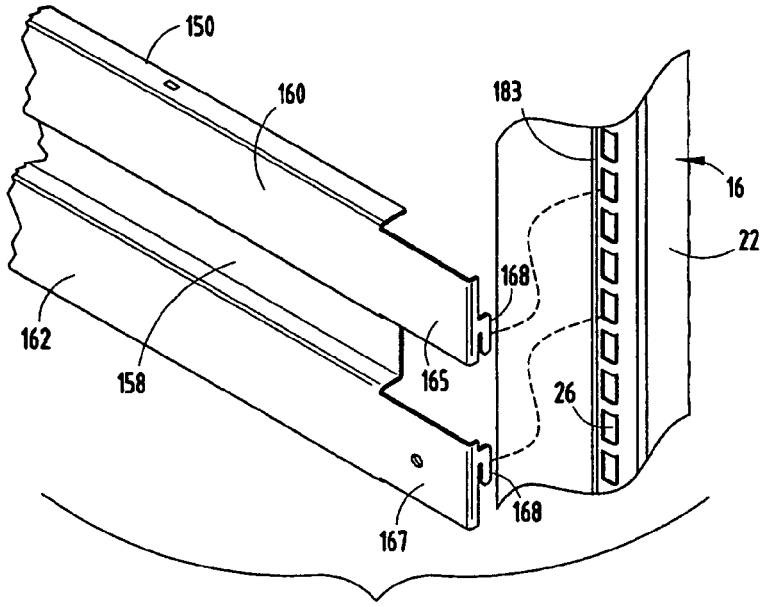
FIG. 17 is an exploded fragmentary perspective view of the bracket of FIG. 14.

With reference to FIGS. 13A-18, there is illustrated a partition panel 10, 12 and/or 14 of the type described hereinabove, having a generally rectangular frame 16 with opposite faces 6 and 7 (FIG. 1A) defined by a rigidly interconnected top 18, a bottom 20 and opposite side members 22, wherein a plurality of vertical slots 26 extend along the opposite side frame members 22. An adapter assembly 140 (FIGS. 13A-18) can be used to horizontally divide one or both of the opposite faces 6 and/or 7 into separate upper and lower portions, 146 and 148, respectively. The adapter assembly includes an adapter bracket 150 which extends generally horizontally between opposite side members 22 of panel frame 16 at a preselected vertical position intermediate the top member 18 and the bottom member 20 of frame 16 to define upper and lower portions 146 and 148, respectively, of an associated one of the opposite faces 6 and/or 7 of frame 16. The adapter bracket includes upper and lower skin retainer surfaces 154, 156, as well as inwardly turned hooks 168 (FIG. 15) at opposite ends of adapter bracket 150 which engage the vertical slots 26 in opposite side frame members 22 to detachably support the adapter bracket 150 at a preselected vertical position (FIG. 17). With reference to FIG. 13A, an upper skin 152 is shaped to enclose the upper portion 146 of panel face 6, 7 and includes at least one connector 176 received on and retained against said skin retainer surface 154 of the adapter bracket 150 to, at least in part, removably support upper skin 152 on frame 16. A lower skin 153 is shaped to enclose the lower portion 148 of panel face 6, 7 and includes at least one connector 176 received on and retained against the skin retainer surface 156 of the adapter bracket 150 to, at least in part, removably support lower skin 153 on said frame 16.

With reference to FIG. 15, adaptor bracket 150 includes an upper flange 154 defining the upper skin retainer surface, a lower flange 156 defining the lower skin retainer surface, and a centrally disposed skin retainer channel 158. An upper front face portion 160 separates channel 158 from upper flange 154, and a lower front face portion 162 separates channel 158 from lower flange 156. Upper front face portion 160 and lower front face portion 162 include extensions 164, 165 and 166, 167 at each of the opposite ends, respectively. Channel 158 extends inwardly from front face portions 160 and 162. With reference to FIG. 16, hooks 168 are disposed at the outside edges of extensions 164, 165, 166 and 167 and project rearwardly and outwardly therefrom. Hooks 168 are adapted to be closely received in the vertical slots 26 of opposite side members 22 of partition frame 16, thereby detachably supporting adaptor bracket 150 at a preselected vertical position and subdividing the partition into a plurality of portions 146 and 148. Portions 146 and 148 and the associated skins or coverings 152 and 153 disposed thereon are generally similar and therefore, only upper portion 146 will be discussed in detail, with it being understood that lower portion 148 has the same characteristics and features, unless otherwise noted.

Figure 17A:
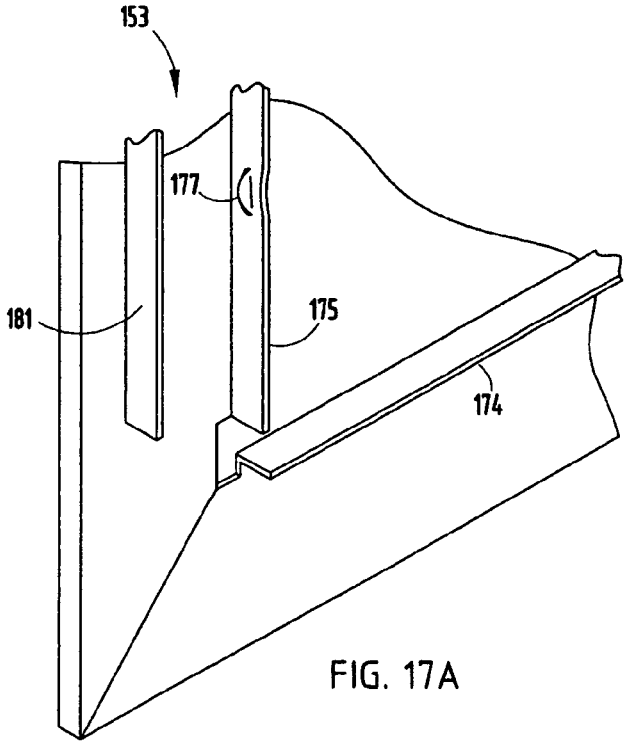
FIG. 17A is a fragmentary enlarged view of an interior portion of one of the covering skins.
Figure 18:
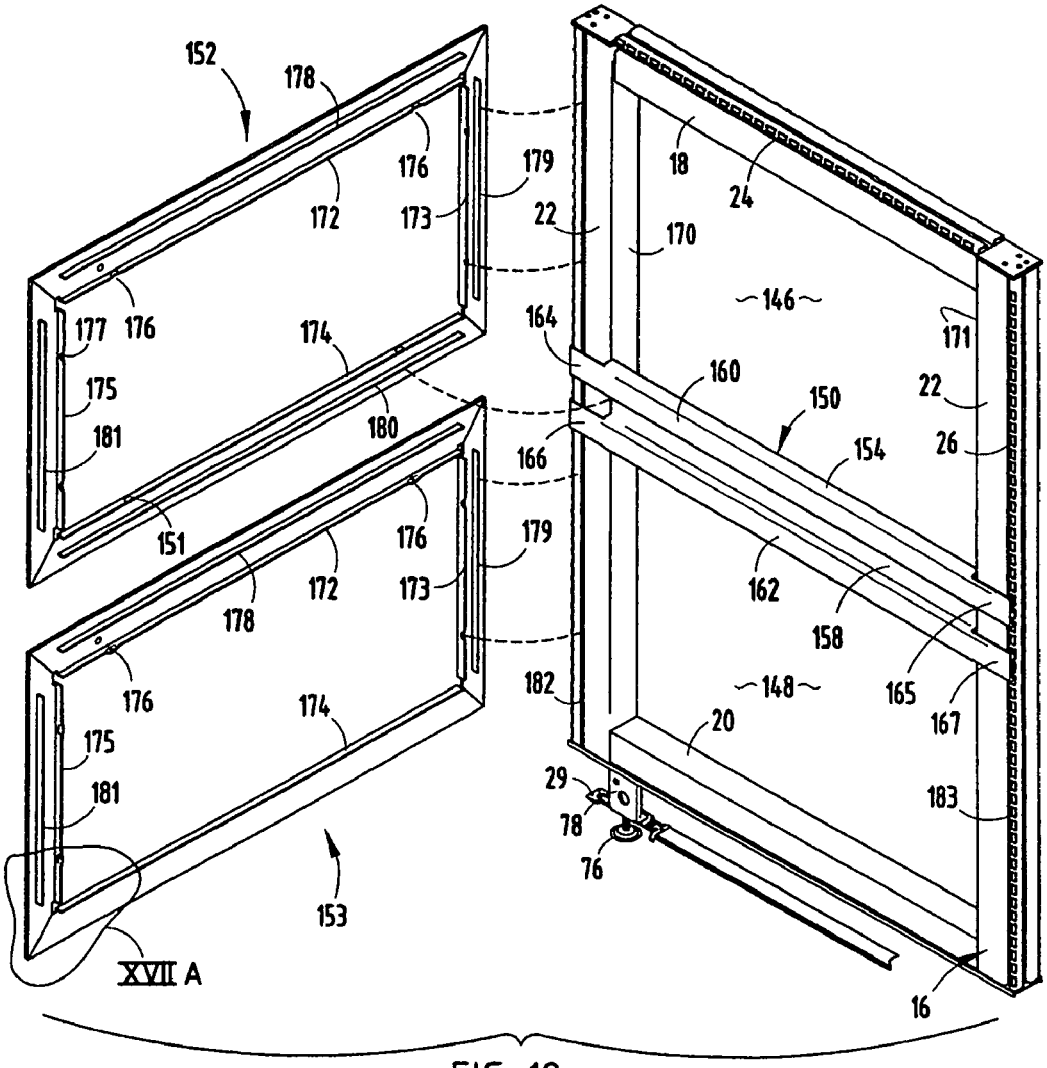
FIG. 18 is a perspective view of the bracket of FIG. 14 installed on a partition frame with a pair of covering skins exploded therefrom.
Figure 19:
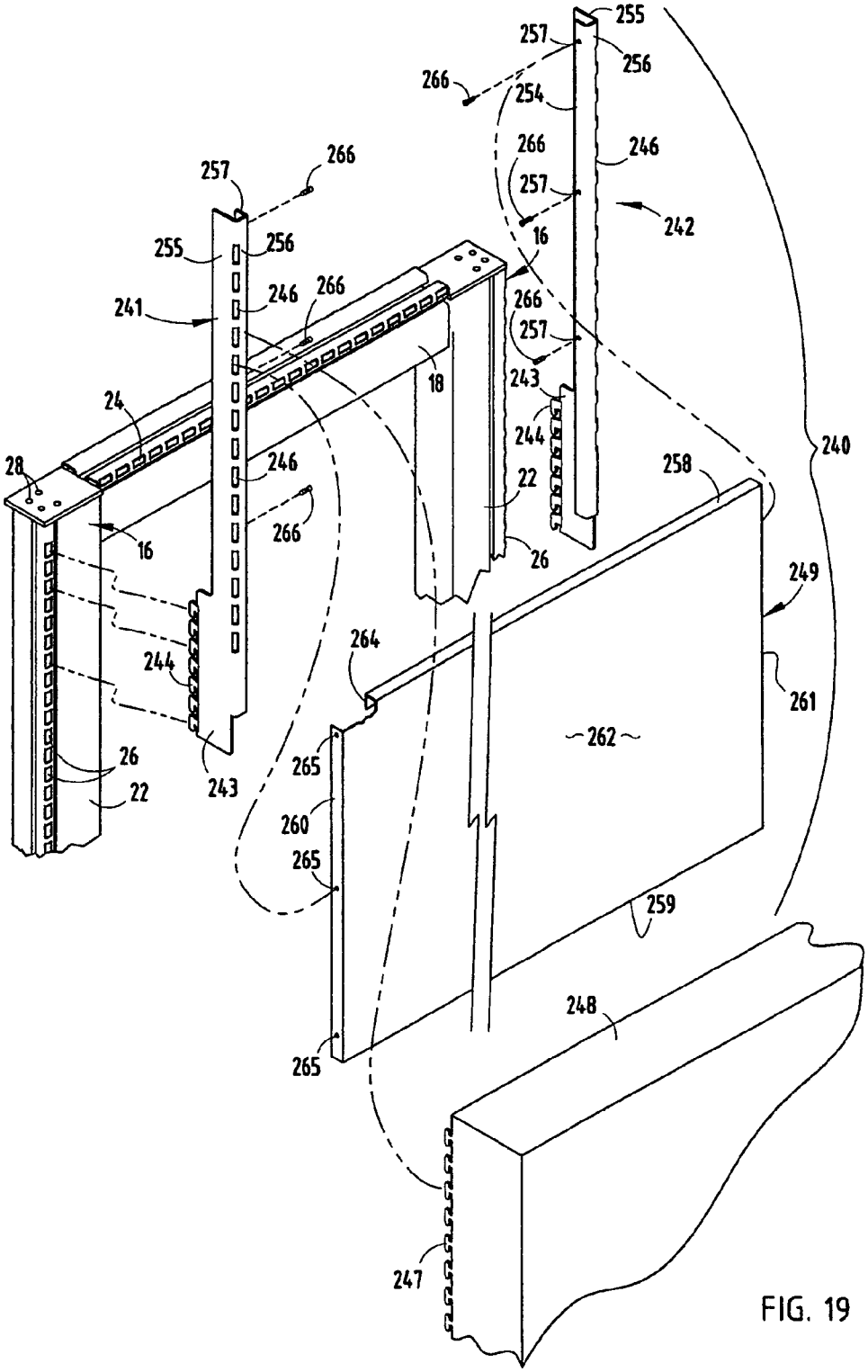
FIG. 19 is an exploded perspective view of another embodiment of the present invention, comprising an up-mount bracket assembly to connect an accessory to an associated partition panel frame using a pair of side brackets and a back panel.
Figure 20:
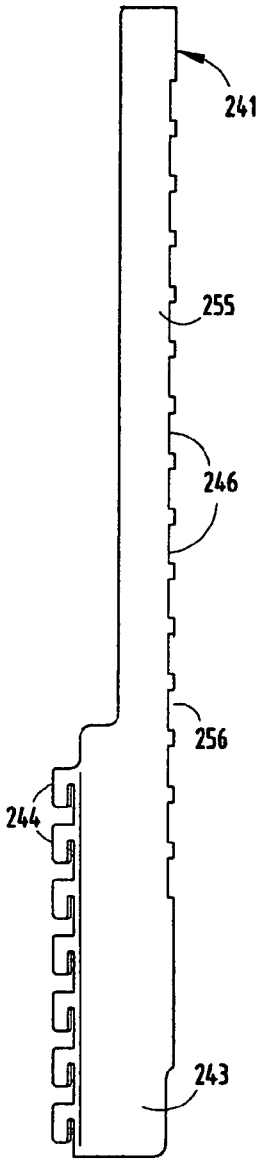
FIG. 20 is a side elevational view of the side bracket of FIG. 19, taken from an exterior side thereof.
Figure 21:
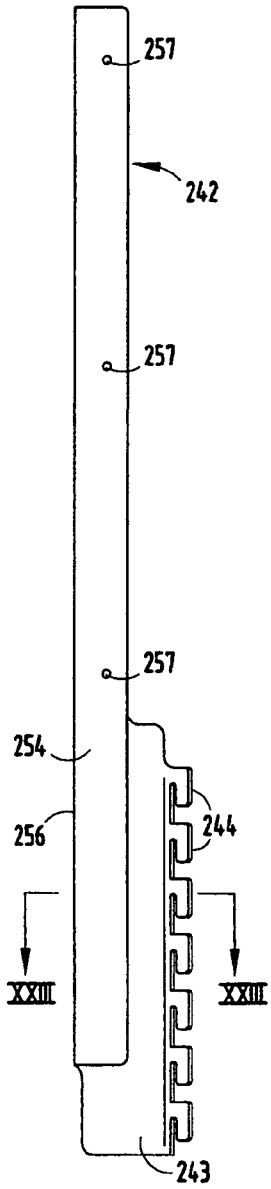
FIG. 21 is a side elevational view of the side bracket of FIG. 19, taken from an interior side thereof.
Figure 22:
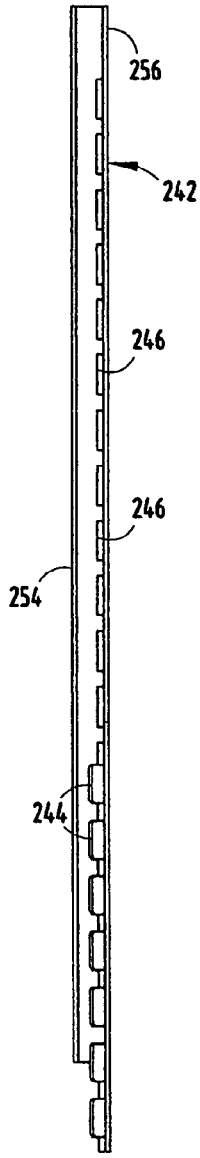
FIG. 22 is a front elevational view of the side bracket of FIG. 19.

As best illustrated in FIG. 18, the upper skin 152 includes a set of inner flanges 172-175, each having one or more fasteners 176 disposed thereon. The inner flanges 172-175 of upper skin 152 are disposed adjacent the inside faces 170, 171 of panel frame side members 22 and the upper bracket flange 154, whereby fasteners 176 detachably mount upper skin 152 to the upper portion 146 of frame 16. In the illustrated embodiment, fasteners 176 are defined by a piercing, wherein flanges 172-175 are punched or pierced at discrete locations along the flanges to raise a portion of the flange and produce a semi-flexible protrusion 177, as best illustrated in FIG. 17A. Upper skin 152 is releasably retained at the upper portion 146 of frame 22 by having flange 178 engage the upper surface of panel frame top member 18, and the protrusions 177 on flange 174 frictionally engage flanges 170 and 171 of frame 16 and flange 154 of adapter bracket 150. Upper skin 152 also includes a set of extensions or outer flanges 178-181 disposed adjacent the outside edges of upper skin 152 and outwardly from inner flanges 172-175. Outer flanges 178, 179 and 181 are received in frame channels 182 and 183 disposed in top frame member 18 and side frame members 22, respectively, while outer flange 180 is received in center channel 158 of adapter bracket 150. Outer flanges 178-181 assist with the retention and rigidity of upper skin 152. More specifically, the rigidity of upper skin 152 is improved because outer flanges 178-181 provide an additional support or brace which extends along each side of the skin, thereby stiffening the edge upon which it is disposed. Furthermore, outer flanges 178-181 abut the adjacent surfaces of frame channels 182 and 183 to capture frame members 18 and 22, as well as the upper portion of adapter bracket 150, between the inner flanges 172-175 and the outer flanges 178-181. This capturing action serves to reinforce the frame 16, and creates a pinching action when protrusions 177 are frictionally engaged, so as to securely, yet removably, retain upper skin 152 on frame 16 and adapter bracket 150.

In the illustrated example, lower skin 153 is generally similar to upper skin 152, except that the lowest portion of lower skin 153, disposed adjacent the bottom frame rail 20 when installed thereon, does not have an outer flange disposed thereon. This is because, in the illustrated embodiment, there is no lower frame portion or channel on bottom member 20 of frame 16, as shown in FIG. 18. In addition, the preferred sequence of installing the panels is accomplished by first installing the upper panel, and then installing the lower panel, such that adapter bracket 150 remains securely attached to frame 16 during assembly.

As with the other embodiments of the present invention, adapter bracket 150 maybe fabricated from numerous materials. Generally a rigid material is used, such that the adapter bracket is capable of securely and rigidly retaining at least a portion of a skin covering to panels 10, 12 and/or 14. Such materials are commonly known within the art and may include, but are not limited to, plastics, metals, ceramics and/or composites thereof. In the illustrated embodiment, steel is used. Additionally, the method of fabricating adapter bracket 150 may be varied, and although the preferred embodiment is fabricated by a stamping and bending process, this is not meant to be limiting in any manner, and the brackets may be fabricated from any known method, including machining, molding or the like. Additionally, although the above-described adapter bracket 150 discusses and illustrates the use of a single bracket subdividing the partition frame into two equal segments, the segments do not have to be equal. Multiple adapter brackets may be used to horizontally subdivide the frame into any number of vertically stacked segments, whether equal to each other or not. Further, although the preferred sequence is to install the upper panel first and then install the adjacent lower panel, this is not meant to be limiting, and the panels may be installed in any sequence.

Alternate Up-Mount Bracket

With reference to FIGS. 19-28, an alternate accessory up-mount bracket assembly 240 is illustrated, which like up-mount bracket 100, is designed to removably mount an accessory, such as a file cabinet, storage bin, shelf, worksurface or the like, to an associated partition panel 10, 12, 14, using the vertically disposed hanger slots 26 extending along the opposite side members 22 of panel frame 16. Alternate up-mount bracket assembly 240 includes first and second side bracket members 241 and 242, respectively, each having a rearward portion 243 with a plurality of hooks 244 configured for close reception in the vertical hanger slots 26 on the opposite side members 22 of panel frame 16 to detachably support the first and second bracket members 241 and 242 on panel frame 16 in a laterally spaced apart, horizontally aligned relationship. Each of the first and second side bracket members 241 and 242 also includes a forward portion 245 with a plurality of vertical support slots 246 configured to receive and detachably retain therein a hanger portion 247 of an associated accessory 248 to detachably support the accessory on mounting bracket assembly 240. The hooks 244 on the rearward portion 243 of each of the first and second side bracket members are disposed at an angle relative to the vertical support slots 246 on the forward portion 245 of side brackets 241, 242, such that after insertion of hooks 244 into the vertical hanger slots 26 in the opposite side members 22 of panel frame 16, the bracket members 241, 242 are pivoted laterally to shift the same into an installed position, wherein the support slots 246 on bracket members 241, 242 assume a forwardly facing, generally parallel relationship. A back member 149 extends between the first and second side bracket members 241 and 242, and is detachably connected therewith to retain side bracket members 241, 242 in the installed position, and thereby positively prevent inadvertent dislodgement of the mounting bracket assembly 240 from the panel frame 16.

Figure 23:
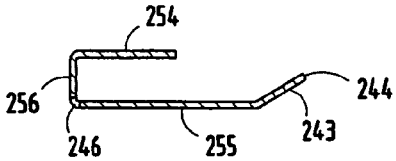
FIG. 23 is an enlarged lateral cross-sectional view of the side bracket of FIG. 19.
Figure 24:
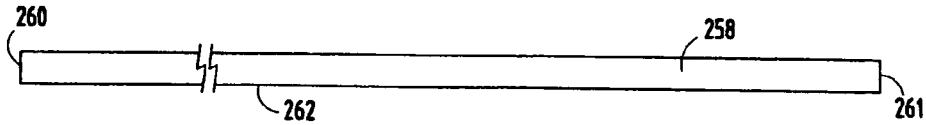
FIG. 24 is a top panel view of the back panel of FIG. 19.
Figure 25:
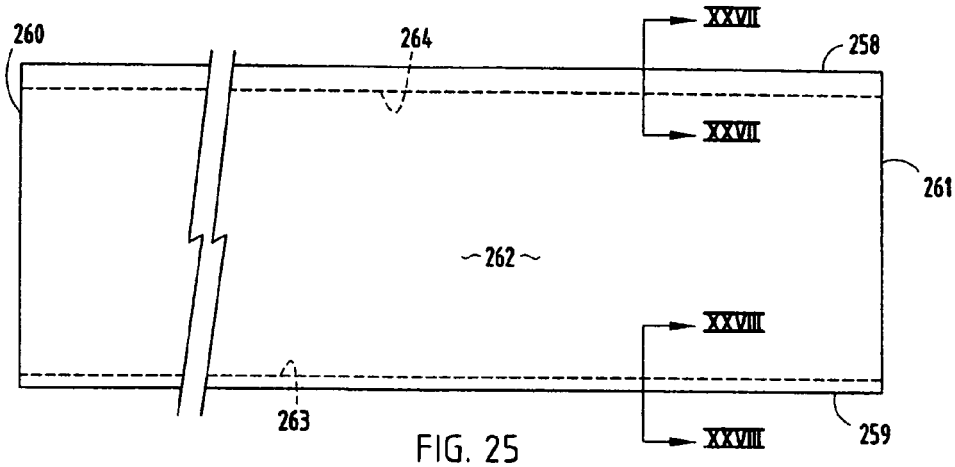
FIG. 25 is a front elevational view of the back panel of FIG. 19.
Figure 26:
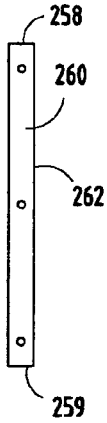
FIG. 26 is an end elevational view of the back panel of FIG. 19.

As best illustrated in FIGS. 20-23, first and second side bracket members 241 and 242 are substantially identical, wherein each has a generally U-shaped configuration defined by first and second generally parallel legs 254 and 255, respectively, which are connected by a base member 256. In the illustrated example, hooks 244 are disposed at the outer end of the second leg 255, and are oriented at an acute angle with respect thereto. Slots 246 extend along the length of base member 256, and fastener apertures 257 are provided in first leg 254 to retain back member 249 in place, as described in greater detail hereinafter. As best illustrated in FIG. 23, second leg 255 is wider than first leg 254, such that hooks 244 protrude a substantial distance inwardly from the free end of first leg 254 at the lower ends of side mounting bracket members 241, 242. The upper ends of side bracket members 241, 242 are generally U-shaped, wherein the first leg 254 and second leg 255 are generally commensurate in width.

Figure 27:
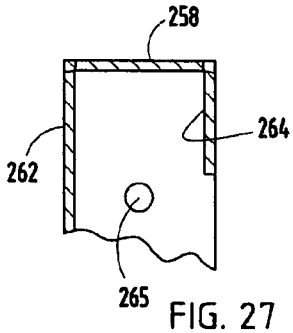
FIG. 27 is an enlarged fragmentary view of a first corner portion of the back panel of FIG. 19.
Figure 28:
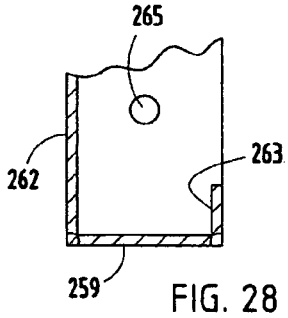
FIG. 28 is an enlarged fragmentary view of a second portion of the back panel of FIG. 19.

As best illustrated in FIGS. 24-28, back member 249 has a generally rectangular plan configuration, and includes inwardly protruding marginal flange members 258-261. Flange members 258-261 are each oriented in a substantially perpendicular relationship to the face portion 262 of back member 249, so as to create a box-like construction. As best illustrated in FIGS. 27 and 28, in the illustrated example, stiffening flanges 263 and 264 are provided along the inward edges of flanges 258-261 to provide additional stiffening to back member 249. The side flanges 260 and 261 of back member 249 include horizontally extending fastener apertures 265 which are positioned to align horizontally with the fastener apertures 257 in side bracket members 241 to receive fasteners therethrough, such as threaded screws, bolts or the like.

In operation, alternate up-mount bracket assembly 240 is installed on an associated panel partition 10, 12, 14 in the following manner. Side mounting brackets 241, 242 are both positioned in a preselected vertical location along the opposite side frame members 22 of panel frame 16, such that side bracket members 241, 242 assume a horizontally aligned relationship. Side bracket members 241 and 242 are pivoted about a generally vertical axis in an inward direction, such that hooks 244 are parallel with and received in the hanger slots 26 on panel frame 16. Side bracket members 241, 242 are then lowered slightly to engage hooks 244 in hanger slots 26 to securely support the same. Side brackets 241, 242 are then pivoted back about a generally vertical axis in an outward direction, such that the support slots 246 assume a forwardly facing, generally parallel relationship that defines an installed position. In the installed position, the legs 254 and 255 of side brackets 241, 242 assume a generally parallel relationship. Back member 249 is then inserted between the side bracket members 241, 242, such that the side flanges 260 and 261 of back member 249 abut the adjacent first legs 254 on side bracket members 241, 242. Back member 249 is adjusted vertically between side members 241, 242, such that the fastener apertures 265 on the side flanges 260, 261 of back member 249 are horizontally aligned with the fastener apertures 257 in the side bracket members 241, 242. Fasteners 266, such as threaded screws or the like, are then inserted through the horizontally aligned fastener apertures 265 and 257 to detachably, yet securely, mount back member 249 between side bracket members 241, 242 to create a complete assembly. The attachment of back member 249 to side bracket members 241, 242 positively prevents side bracket members 241, 242 from being rotated out of their installed position, so that the up-mount bracket assembly 240 cannot be inadvertently dislodged from the panel frame 16.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. In a partition system of the type having at least first and second partition panels, each including a generally rectangular frame defined by rigidly interconnected top, bottom and opposite side members, with a plurality of horizontal slots extending along said top member, vertically oriented mounting apertures disposed adjacent opposite ends of said top member and said bottom member, and a skin covering at least a major portion of said frame, while leaving said horizontal slots exposed, the improvement of an off-module connector detachably connecting said first partition panel with said second partition panel in a non-parallel, angular relationship at a location on said first partition panel between said opposite side members thereof, comprising:

a top connector bracket having a hook portion thereof detachably engaged in one of said horizontal slots on said first partition panel, and a plate portion thereof positioned generally opposite of said hook portion, and including at least one vertically oriented fastener aperture positioned to mate with a first one of said mounting apertures adjacent said top member on said second partition panel;

a first fastener inserted through said fastener aperture in said top connector bracket and engaged in said first mounting aperture adjacent said top member on said second partition panel;

a rack having a plurality of horizontal slots extending along the length thereof, and connected with said first partition panel at a location generally below said bottom member thereof, such that said horizontal slots therein are accessible;

a bottom connector bracket having a hook portion thereof detachably engaged in at least one of said horizontal slots of said rack on said first partition panel, and a plate portion thereof positioned generally opposite said hook portion of said bottom connector bracket, and including at least one vertically oriented fastener aperture positioned to mate with a second one of said mounting apertures adjacent said bottom member of said second partition panel; and a second fastener inserted into said fastener aperture in said bottom connector bracket, and engaged in said second mounting aperture adjacent said bottom member on said second partition panel to securely, yet removably, mount said second partition panel on said first partition panel in an off-modular relationship.

2. A partition system as set forth in claim 1, wherein:

said top connector bracket is generally flat with said hook portion and said plate portion thereof being substantially coplanar.

3. A partition system as set forth in claim 1, wherein:

said rack is generally L-shaped and includes a pair of mounting flanges disposed at opposite ends of said rack; and said horizontal slots are disposed generally perpendicular to said mounting flanges.

4. A partition system as set forth in claim 3, wherein:

said mounting flanges each include at least one aperture for receiving a third and a fourth fastener therethrough for detachably connecting said mounting flanges to said bottom of said first partition panel.

5. A partition system as set forth in claim 1, wherein:

said bottom connector bracket includes first and second hooks defining said hook portion and engaging first and second ones of said slots in said rack.

6. An off-module connector for partition systems of the type having at least first and second partition panels, each including a generally rectangular frame defined by rigidly interconnected top, bottom and opposite side members, with a plurality of horizontal slots extending along said top member, vertically oriented mounting apertures disposed adjacent opposite ends of said top member and said bottom member, and a skin covering at least a major portion of said frame, while leaving said horizontal slots exposed, comprising:

a top connector bracket having a hook portion thereof shaped for detachable engagement in one of the horizontal slots on the first partition panel, and a plate portion thereof positioned generally opposite of said hook portion, and including at least one vertically oriented fastener aperture positioned to mate with a first one of the mounting apertures adjacent the top member on the second partition panel;

a first fastener inserted through the fastener aperture in the top connector bracket and engaged in the first mounting aperture adjacent the top member on the second partition panel;

a rack having a plurality of horizontal slots extending along the length thereof, and shaped for connection with the first partition panel at a location generally below the bottom member thereof, such that said horizontal slots therein are accessible;

a bottom connector bracket having a hook portion thereof detachably engaged in at least one of said horizontal slots of said rack on the first partition panel, and a plate portion thereof positioned generally opposite said hook portion of said bottom connector bracket, and including at least one vertically oriented fastener aperture positioned to mate with a second one of the mounting apertures adjacent the bottom member of the second partition panel; and a second fastener inserted into said fastener aperture in said bottom connector bracket, and engaged in the second mounting aperture adjacent the bottom member on the second partition panel to securely, yet removably, mount the second partition panel on the first partition panel in an off-modular relationship.

7. An off-module connector as set forth in claim 6, wherein:

said top connector bracket is generally flat with said hook portion and said plate portion thereof being substantially coplanar.

8. An off-module connector as set forth in claim 6, wherein:

said rack is generally L-shaped and includes a pair of mounting flanges disposed at opposite ends of said rack; and said horizontal slots are disposed generally perpendicular to said mounting flanges.

9. An off-module connector as set forth in claim 8, wherein:

said mounting flanges each include at least one aperture for receiving a third and a fourth fastener therethrough for detachably connecting said mounting flanges to the bottom member of the first partition panel.

10. An off-modular connector as set forth in claim 6, wherein:

said bottom connector bracket includes first and second hooks defining said hook portion and engaging first and second ones of said slots in said rack.

11. A method for detachably interconnecting partition panels in a non-parallel, off-modular relationship, comprising:

providing first and second partition panels, each including a generally rectangular frame defined by rigidly interconnected top, bottom and opposite side members, with a plurality of horizontal slots extending along the top member, vertically oriented mounting apertures disposed adjacent opposite ends of the top member and the bottom member, and a skin covering at least a major portion of the frame, while leaving the horizontal slots exposed;

forming a top connector bracket having a hook portion thereof shaped for detachable engagement in one of the horizontal slots on said first partition panel, and a plate portion thereof positioned generally opposite of the hook portion, and including at least one vertically oriented fastener aperture positioned to mate with a first one of the mounting apertures adjacent said top member on said second partition panel;

a first fastener inserted through said fastener aperture in said top connector bracket and engaged in said first mounting aperture adjacent said top member on said second partition panel;

a rack having a plurality of horizontal slots extending along the length thereof, and connected with said first partition panel at a location generally below said bottom member thereof, such that said horizontal slots therein are accessible;

a bottom connector bracket having a hook portion thereof detachably engaged in at least one of said horizontal slots of said rack on said first partition panel, and a plate portion thereof positioned generally opposite said hook portion of said bottom connector bracket, and including at least one vertically oriented fastener aperture positioned to mate with a second one of said mounting apertures adjacent said bottom member of said second partition panel; and a second fastener inserted into said fastener aperture in said bottom connector bracket, and engaged in said second mounting aperture adjacent said bottom member on said second partition panel to securely, yet removably, mount said second partition panel on said first partition panel in an off-modular relationship.

12. A method for detachably interconnecting partition panels as set forth in claim 11, wherein:

said top connector bracket is generally flat with said hook portion and said plate portion thereof being substantially coplanar.

13. A method for detachably interconnecting partition panels as set forth in claim 11, wherein:

said rack is generally L-shaped and includes a pair of mounting flanges disposed at opposite ends of said rack; and said horizontal slots are disposed generally perpendicular to said mounting flanges.

14. A method for detachably interconnecting partition panels as set forth in claim 13, wherein:

said mounting flanges each include at least one aperture for receiving a third and a fourth fastener therethrough for detachably connecting said mounting flanges to said bottom member of said first partition panel.

15. A method for detachably interconnecting partition panels as set forth in claim 11, wherein:

said bottom connector bracket includes first and second hooks defining said hook portion and engaging first and second ones of said slots in said rack.

* * * * *

UNITED STATES PATENT AND TRADEMARK OFFICE

CERTIFICATE OF CORRECTION

PATENT NO. : 7,818,932 B2
APPLICATION NO. : 12/587872
DATED : October 26, 2010
INVENTOR(S) : David C. Eberlein et al.

It is certified that error appears in the above-identified patent and that said Letters Patent is hereby corrected as shown below:

Title Page,
After "(65) Prior Publication Data US 2010/0064597 A1 Mar. 18, 2010" insert --Related U.S. Application Data (62) Division of application 11/034,466, filed on January 13, 2005, now Pat. 7,603,821.--.

Column 15,
Lines 43 and 58, "adaptor" should be --adapter--.

Column 16,
Line 46, "maybe" should be --may be--.

Column 20,
Claim 10, line 35, "off-modular" should be --off-module--.

Signed and Sealed this
Thirty-first Day of May, 2011

David J. Kappos

David J. Kappos
*Director of the United States Patent and Trademark Office*